US010119383B2

(12) United States Patent
Mazzanti

(10) Patent No.: US 10,119,383 B2
(45) Date of Patent: Nov. 6, 2018

(54) DOWN-HOLE GAS AND SOLIDS SEPARATION SYSTEM AND METHOD

(71) Applicant: NGSIP, LLC, Houston, TX (US)

(72) Inventor: Daryl V. Mazzanti, Spring, TX (US)

(73) Assignee: NGSIP, LLC, Houston, TX (US)

( * ) Notice: Subject to any disclaimer, the term of this patent is extended or adjusted under 35 U.S.C. 154(b) by 464 days.

(21) Appl. No.: 14/708,484

(22) Filed: May 11, 2015

(65) Prior Publication Data

US 2016/0333681 A1 Nov. 17, 2016

(51) Int. Cl.
*E21B 43/38* (2006.01)
*E21B 43/12* (2006.01)

(52) U.S. Cl.
CPC ..... *E21B 43/38* (2013.01); *E21B 43/126* (2013.01)

(58) Field of Classification Search
CPC ..... E21B 43/36; E21B 43/38
See application file for complete search history.

(56) References Cited

U.S. PATENT DOCUMENTS 1,655,817 A * 1/1928 Marsh ..... E21B 43/38 166/105.5
1,732,499 A * 10/1929 Chancellor ..... E21B 43/38 137/140
2,029,323 A * 2/1936 Jones ..... E21B 19/084 166/105.1
2,137,167 A 11/1938 Lang
2,618,339 A * 11/1952 Glover ..... E21B 43/14 166/106
3,106,526 A * 10/1963 Schmidt ..... E21B 43/38 166/105.1
4,476,925 A * 10/1984 Cox ..... E21B 43/086 166/105.1
4,519,457 A 5/1985 Holland
4,951,752 A 8/1990 Coleman
5,284,208 A 2/1994 Clemens
5,295,537 A * 3/1994 Trainer ..... E21B 43/38 166/105.1
5,314,018 A 5/1994 Cobb
5,450,902 A 9/1995 Matthews
5,535,825 A 7/1996 Hickerson
5,553,669 A * 9/1996 Trainer ..... B01D 29/114 166/105.1
RE35,454 E 2/1997 Cobb
5,662,167 A * 9/1997 Patterson ..... B01D 21/0003 166/105.1
6,039,121 A 3/2000 Kisman
6,079,491 A 6/2000 Stuebinger
(Continued)

OTHER PUBLICATIONS

PCT International Preliminary Report on Patentability for International Application No. PCT/US12/47178 (our matter 0103PCT) dated Jan. 28, 2014.

(Continued)

*Primary Examiner* — Blake E Michener
(74) *Attorney, Agent, or Firm* — Clark Hill Strasburger

(57) ABSTRACT

A gas and solids separation system is disclosed to separate gas and solids in a subterranean wellbore thereby preventing the gas and solids from interfering with down-hole equipment. The system includes shrouds and diverters that directs the gas away from the intake of the down-hole artificial lift equipment and also utilizes solids collection chambers and shields which separate and trap solids.

15 Claims, 15 Drawing Sheets

(56) References Cited

U.S. PATENT DOCUMENTS 6,138,758 A 10/2000 Shaw
6,179,056 B1 1/2001 Smith
6,189,614 B1 2/2001 Brady
6,202,744 B1 * 3/2001 Shaw ..... B01D 17/0211 166/105
6,237,692 B1 5/2001 Averhoff
6,276,452 B1 * 8/2001 Davis ..... E21B 21/002 166/107
6,298,918 B1 10/2001 Franco
6,364,013 B1 * 4/2002 Watson ..... E21B 37/02 166/105
6,367,555 B1 4/2002 Senyard, Sr.
6,382,317 B1 5/2002 Cobb
6,443,229 B1 9/2002 Kulka
6,457,522 B1 10/2002 Bangash
6,568,475 B1 * 5/2003 Grubb ..... E21B 27/02 166/305.1
6,684,956 B1 * 2/2004 Berry ..... E21B 43/14 166/250.01
7,069,985 B2 * 7/2006 Wang ..... E21B 43/128 166/105
7,163,063 B2 1/2007 Seams
7,487,838 B2 * 2/2009 Knight ..... E21B 43/128 166/106
7,753,113 B1 * 7/2010 Penisson ..... E21B 27/00 166/162
7,766,081 B2 * 8/2010 Brown ..... E21B 43/128 166/105.5
7,766,085 B2 8/2010 Stephenson
8,006,756 B2 8/2011 Mazzanti
8,162,064 B1 * 4/2012 Penisson ..... E21B 27/00 166/335
8,196,657 B2 * 6/2012 Kennedy ..... E21B 43/128 166/105.5
8,512,009 B2 8/2013 Wonitoy
8,955,598 B2 * 2/2015 Brown ..... E21B 43/121 166/105.5
8,960,282 B2 * 2/2015 Zhu ..... E21B 27/00 166/105.1
8,973,662 B2 * 3/2015 Xu ..... E21B 27/00 166/105.1
9,416,626 B2 * 8/2016 Xu ..... E21B 37/00
9,631,472 B2 * 4/2017 Reid
2005/0109505 A1 5/2005 Seams
2008/0093085 A1 * 4/2008 Knight ..... E21B 43/128 166/369
2009/0065202 A1 * 3/2009 Brown ..... E21B 43/128 166/267
2009/0145595 A1 6/2009 Mazzanti
2009/0194293 A1 8/2009 Stephenson
2009/0211755 A1 * 8/2009 Dyer ..... E21B 43/14 166/252.1
2009/0272538 A1 * 11/2009 Kennedy ..... E21B 43/128 166/369
2011/0171049 A1 7/2011 Wonitoy
2011/0278015 A1 * 11/2011 Mazzanti ..... E21B 17/18 166/372
2013/0068455 A1 * 3/2013 Brown ..... E21B 43/121 166/265
2014/0014358 A1 * 1/2014 Leitch ..... E21B 27/005 166/369
2015/0053394 A1 * 2/2015 Reid ..... E21B 43/128 166/105.3

OTHER PUBLICATIONS

PCT International Search Report for International Application No. PCT/US12/47178 (our matter 0103PCT) dated Feb. 1, 2013.
PCT Written Opinion of the International Searching Authority for International Application No. PCT/US12/47178 (our matter 0103PCT) dated Feb. 1, 2013.
Weatherford International, Ltd., Weatherford T-2 On-Off Tool, 2009.

* cited by examiner

DOWN-HOLE GAS AND SOLIDS SEPARATION SYSTEM AND METHOD

BACKGROUND OF THE DISCLOSURE

1. Field of the Disclosure

The disclosure relates to artificial lift production systems and methods deployed in subterranean oil and gas wells, and more particularly relates to systems and methods for separating gas and solids from reservoir fluids in vertical, deviated, or horizontal wellbores.

2. Description of the Related Art

Many oil and gas wells will experience liquid loading at some point in their productive lives due to the reservoir's inability to provide sufficient energy to carry wellbore liquids to the surface. The liquids that accumulate in the wellbore may cause the well to cease flowing or flow at a reduced rate because of the back-pressure exerted by the liquids on the reservoir. Flow from the reservoir is determined by the differential pressure between the reservoir and the surface facilities. Typically, a higher pressure differential equates to a higher production rate from the well. To increase or re-establish the production, operators may introduce additional energy to the wellbore, known as artificial lift, to increase the lifting of the liquids to the surface.

Several methods of artificial lift are known to the oil and gas industry, and artificial lift selection is often determined by the efficiency of a particular artificial lift method in handling gas and solids in conjunction with conventional down-hole gas and solids separation equipment. It is well known to persons of ordinary skill in the art that gas and solids in reservoir fluids, after entering the wellbore, may be detrimental to down-hole pumping systems. Both solids and gases may cause inefficiencies and failures in the down-hole equipment. Higher production rates have higher fluid velocities than lower production rates in similar-sized wellbores. When fluid velocities are high, there is a tendency to carry gas bubbles and solids along with the liquids into the conventional gas separation devices, which, in turn, allows the gas bubbles and solids to enter into the intake of the down-hole pumps. Conventional gas separation and solids removal systems are inadequate for higher production rates in a large number of wellbores as explained herein.

A common form of artificial lift is a sucker rod pump, and a common form of a down-hole gas and solids separation device is provided by a "poor boy separator". This device has a concentric tubing arrangement consisting of an outer joint of tubing with a closed lower end and openings on the upper end. The outer tubing contains an inner tubing segment called a "dip tube" that serves to separate gas from the liquids and, also, as a conduit for the separated liquids to enter into the intake of the pump. A region called the "mud anchor" is formed between the terminus of the dip tube and the bottom of the outer tubular. The mud anchor allows for solids to settle within the separator.

The sucker rod pump cycle consists of an upstroke and a down-stroke. Most rod pumps are designed to lift liquids on the upstroke, whereas during the down-stroke, the pump plunger is merely lowered and fills a chamber with liquids without any significant fluid displacement that could result in a liquid velocity within the down-hole separator. During the upstroke, gas and liquids are drawn from the casing annulus into the upper openings in the outer tubular of the separator since the velocity induced by the pump exceeds the velocity of the gas bubbles rising in the reservoir fluids in the casing annulus. The liquids and gas bubbles travel down the annulus between the dip tube and outer tubing.

During the down-stroke of the pump, as described previously, there is no liquid velocity in the separator, hence there is time for the gas to rise up and out of the separator through the openings in the upper end of the separator. Any gas bubbles that remain in the separator when the velocity begins to increase during the pump's upstroke will eventually be drawn into the intake of the pump, regardless of the length of the separator. The conventional separator size, and therefore capacity, is often limited by the casing size from reaching the maximum capacity limit of the production pump. In other words, the well casing size subsequently causes a reduction in the size of the outer tubular of the separator and the dip tube.

The sufficiency of the velocity of the liquids to draw gas down to the end of the dip tube is determined by the cross-sectional area of the annulus between the inner and outer tubulars of the separator and the production rate of the pump. When gas is drawn down to the lower end of the dip tube, the gas can enter the pump intake, which will reduce the efficiency of the pump.

A limitation of many poor boy separators is that these separators provide high liquid velocities due to limited cross-sectional area of the separator. This cross-sectional area is limited, in part, by the fact that the outer tubular of the separator must fit inside of the casing of the wellbore.

For example, a typical separator used in a 4½ inch (11.43 cm) casing within a wellbore has an outer tubular diameter of 2⅜ inches (6.02 cm) with a dip tube diameter of 1.66 inches (4.22 cm), as would be understood by a person of ordinary skill in the art. The inner and outer diameter of 2⅜ inch tubing (6.02 cm) is 1.995 inches (5.07 cm) and 2.375 inches (6.02 cm), respectively, and the inner and outer diameter of 1.66 inch tubing (4.22 cm) is 1.38 inches (3.51 cm) and 1.66 inches (4.22 cm), respectively. Published studies have shown that a majority of gas bubbles will continue to rise in salt water below velocities of 6 inches per second (15.24 cm per second). At fluid velocities of 6 inches per second (15.24 cm per second), the referenced separator can move approximately 52 barrels of liquid per day (8.27 cubic meters per day) before gas will be drawn into the intake of the pump. Another common size of separator is 2⅞ inches (7.3 cm) by 1.66 inches (4.22 cm) that has a limit of approximately 132 barrels of liquid per day (21 cubic meters per day) before gas will be drawn into the pump intake at a fluid velocity of 6 inches per second (15.24 cm per second). The inner and outer diameter of the 2⅞ inch tubing (7.3 cm) is 2.441 inches (6.22 cm) and 2.875 inches (7.3 cm), respectively.

Designing the outer tubular of the separator with a larger inner diameter is one way to increase the cross-sectional area of the separator, and, thus, lower the fluid velocity inside the separator; however, if the wall thickness of the separator is too thin, the structural integrity of the separator will be compromised. If both the inner and outer diameter of the separator are increased, then the cross-sectional area of the annulus between the separator and the casing wall decreases, which may restrict flow and induce back-pressure in the wellbore below the separator. The back-pressure will reduce the flow rate from the reservoir and defeat the purpose of using a larger diameter separator to increase the overall production rate. Furthermore, small tolerances between the separator and the casing wall may allow the accumulation of solids in or about the gap between the separator and the casing wall, and this accumulation may stick the separator in place. Reducing the outer diameter of the dip tube will also increase the cross-sectional area; however, a smaller inside diameter dip tube will also increase the friction of the liquids feeding the pump intake, which can starve the pump for liquids and increase the risk of plugging the dip tube with scale or solids.

Wells with small casing or liner sizes limit the application of conventional down-hole pumps, and the conventional down-hole gas separation equipment necessarily has to be smaller to accommodate the smaller casing and liner sizes. Many operators are currently drilling wells with smaller casing sizes in order to lower the upfront costs of drilling and completion. However, these operators still desire production rates well in excess of what conventional down-hole separators can deliver. Also, the higher fluid velocity in the separator that makes gas separation difficult also affects solids separation. There have been several attempts with various separator designs to lower the velocity of the liquid inside the separator. These designs have had varying degrees of success but yet still have limited production rates below the desires of operators. Similarly, attempts to separate out solids in the wellbore have proven to be inadequate.

A main operational concern for many pumps such as rod pumps, ESPs, and piston pumps is the presence of gas in the pumps. Since gas is highly compressible compared to liquids, these types of pumps operate efficiently only when gas is not present in the pump chamber. The presence of the gas may reduce lubrication, increase friction, allow heat build-up, increase cavitation, and increase vibration of the pump. All of these complications may reduce pump efficiency or cause the pump to fail. Reduced life expectancy of the pump due to the presence of gas in the pump can result in costly and time consuming repairs and/or replacement of the pump.

The presence of gas in the pumps can also cause the pumps to experience "gas lock", which occurs when there is an insufficient amount of liquid near the intake of the pump. During operation of the pump, gas within the pump chamber may expand and compress due to the action of the pump and the change in volume of the pump chamber. The outflow of gas being compressed may prevent or limit liquids form entering the pump until the gas is expelled from the pump chamber. Therefore it is important that the intakes of the down-hole pumps be placed in liquids and down-hole separation equipment be designed to keep gas from entering the pump; otherwise, the efficiency of the pump is reduced.

One of the main limiting factors of conventional rod pump lift design is the use of a tubing anchor. In general, rod pumps require the production tubing to be anchored to prevent movement of the tubing that is induced by the motion of the rods, pump, and fluids in the production tubing string. Tubing anchors are mechanical devices that connect the tubing to the casing wall by a set of slips, similar to the way a packer operates, but without the sealing elastomers of a packer. Instead of sealing, the tubing anchors allow gas and liquids to flow around the tubing anchor so that the gas may flow to the surface and by-pass entering the intake to the pump. Movement of the production tubing can cause frictional contact between the production tubing and the casing, which may result in a down-hole failure in the tubing and/or the casing. Movement of the production tubing string may also cause the pump to lose efficiency since the movement of the tubing string with respect to the plunger lowers the effective stroke length of the plunger in the pump barrel.

Currently the most efficient form of down-hole gas separation is provided by a packer type separation system that forces all reservoir fluids into the casing-tubing annulus to utilize the larger cross-section of the annulus to reduce velocities of the liquid and, thereby, allow the gas to separate from the liquids. The packer is used instead of the tubing anchor for securing the tubing to the casing and, since the reservoir fluids enter the casing-tubing annulus above the packer, there are no restrictions on the reservoir fluids and gas to flow as is the case with the tubing anchor. However, one limitation of packer type separation systems is that solids are also introduced into the casing annulus which can settle on top of the packer, potentially causing the packer to become stuck in the wellbore. A stuck packer may require an expensive work-over should the packer need to be removed from the wellbore.

What is needed is a comprehensive system that provides superior gas and solid separation and allows for higher production rates. Additionally, a need exists for a separation system that will work in small diameter casing, including sizes on the order of 4½ inches (11.43 cm).

There is also a need for a packer type gas and solids separation system with higher liquid throughput that will trap solids before they enter or settle out on down-hole equipment.

BRIEF SUMMARY OF THE DISCLOSURE

In aspects, the present disclosure is related to an apparatus and system for providing down-hole separation in oil and gas wells. Specifically, the present disclosure is related to providing separation of gasses and solids from reservoir fluids in a wellbore.

One embodiment according to the present disclosure is a system for use in a wellbore extending from a surface to a subterranean reservoir, the system comprising: a casing disposed in the wellbore; a tubular string extending into the casing; a first solids collection annular sealing device disposed in the tubular string; and a first solids collection device disposed in the tubular string and connected to the first solids collection annular sealing device, the first solids collection device comprising: a first inner tubular connected to the first solids collection annular sealing device, herein the first inner tubular has one or more openings; a first solids collection annulus formed by the first inner tubular and the tubular string, wherein the first solids collection annular sealing device forms an annular seal between the tubular string and the first inner tubular; and a first cover disposed on an end of the first inner tubular opposite the first solids collection annular sealing device above the one or more openings in the first inner tubular, wherein the first cover is configured to redirect flow out of the one or more openings in the first inner tubular. The first cover may comprise one or more sections of screen configured to block at least some solids. The system may also include a second solids collection device disposed in the tubular string and connected to the second solids collection annular sealing device, the second solids collection device comprising: a second inner tubular connected to the second solids collection annular sealing device, wherein the second inner tubular has one or more openings; a second solids collection annulus formed by the second inner tubular and the tubular string, wherein the second solids collection annular sealing device forms an annular seal between the tubular string and the second inner tubular; and a second cover disposed on an end of the second inner tubular opposite the second annular sealing device above the one or more openings in the second inner tubular, wherein the second cover is configured to redirect flow out of the one or more openings in the second inner tubular; wherein the second solids collection device is disposed above the first solids collection device. The system may include a casing annular sealing device disposed in the casing and sealingly engaged to the tubular string and forming an annular barrier in a casing annulus formed between the casing and the tubular string. The first solids collection annular sealing device and the first solids collection device may be disposed above the casing annular sealing device. The first and second solids collection devices may be disposed above, below, both relative to the casing annular sealing device. The tubular string may include one or more openings between the first solids collection annular sealing device and the opposite end of the first inner tubular configured to allow flow between the first solids collection device and the casing annulus. The casing annular sealing device may be a packer. The system may include a fluid displacement device disposed in the tubular string above the first solids collection device. The system may also include bi-flow annular sealing device disposed in the tubular string below the fluid displacement device and above the first solids collection device; a bi-flow inner tubular connected to the bi-flow annular sealing device and extending downward from the bi-flow annular sealing device; and a bi-flow connector disposed in the tubular string above the first solids collection device and sealingly engaged with the bi-flow inner tubular, wherein the tubular string comprises one or more openings above the bi-flow connector and below the bi-flow annular sealing device configured to allow flow between a bi-flow annulus and the casing annulus, wherein the bi-flow annulus is formed by the bi-flow inner tubular and the tubular string. The bi-flow connector may include: a tubular with a first end, a second end, an inner bore and a thickness; one or more first channels through the thickness configured to allow fluids to pass from outside the thickness to the inner bore; and one or more second channels through the thickness configured to allow fluids to pass from the first end to the second end, wherein the one or more first channels and the one or more second channels do not intersect. The one or more second channels are aligned vertically on only one side of the bi-flow connector and the one or more openings in the tubular string above the bi-flow connector and below the bi-flow annular sealing device are aligned on a substantially opposite side of the wellbore as the one or more second channels. The system may also include a shield comprising a tubular and surrounding the one or more second channels and the one or more openings above the bi-flow connector with a closed end farthest from the surface and an open end closest to the surface.

The embodiment may also include one or more of: a flow blocking device disposed in the tubular string between the fluid displacement device and the solids collection device, wherein the tubular string further comprises: one or more openings below the flow blocking device and above the first solids collection device configured to allow flow between the interior of the tubular string and the casing annulus; and one or more openings below the fluid displacement device and above the flow blocking device configured to allow flow between the casing annulus and the interior of the tubular string. The embodiment may also include one or more of: a shield disposed around the tubular string, above the casing annular sealing device and below the one or more openings in a tubular string above the flow blocking device, wherein a shield is dimensioned to substantially cover a surface of the casing annular sealing device; and a first shroud comprising a tubular disposed in an off-centered position about the tubular string and surrounding at least one of: 1) said one or more openings in said tubular string below the flow blocking device and 2) said one or more openings in said tubular string above the flow blocking device, wherein the first shroud is configured to divert flow of said reservoir fluids emanating from said one or more openings below said flow blocking device away from said one or more openings above the flow blocking device. In some aspects, the said one or more openings above said flow blocking device are positioned on substantially the opposite side of said tubular from said one or more openings below said flow blocking device. In some aspects, a second shroud surrounding the one or more openings below said flow blocking device and open at a top end; wherein said one or more openings above said flow blocking device are positioned on substantially the same side on said tubular string as said one or more openings below said flow blocking device, wherein the first shroud surrounds said one or more openings above said flow blocking device and comprises an opening on a side of the tubular string that is opposite the one or more openings above the flow blocking device, and wherein the first shroud is closed on both ends.

Another embodiment according to the present disclosure is a method for collecting solids from reservoir fluids, the method comprising: collecting solids in a tubular string in a casing in a wellbore using a solids collection device, the solids collection device comprising: a first inner tubular connected to the first solids collection annular sealing device, herein the first inner tubular has one or more openings; a first solids collection annulus formed by the first inner tubular and the tubular string, wherein the first solids collection annular sealing device forms an annular seal between the tubular string and the first inner tubular; and a first cover disposed on an end of the first inner tubular opposite the first solids collection annular sealing device above the one or more openings in the first inner tubular, wherein the first cover is configured to redirect flow out of the one or more openings in the first inner tubular.

In another embodiment according to the present disclosure is a system for use in a wellbore extending from the surface to a reservoir having reservoir fluids, and the system comprising: a casing disposed in the wellbore; a tubular string extending into the casing; a flow blocking device disposed in the tubular string, wherein the tubular string further comprises: one or more openings below the flow blocking device; and one or more openings above the flow blocking device; and a first shroud comprising a tubular and surrounding at least one of the one or more openings below the flow blocking device and the one or more openings above the flow blocking device, wherein the first shroud is off-centered with respect to the tubular string and wherein the first shroud is configured to divert flow of said reservoir fluids emanating from said one or more openings below said flow blocking device away from said one or more openings above the flow blocking device. The first shroud may be made of at least one of: metal, fiberglass, elastomer, carbon, carbon fiber, polymers, resin, ceramic, plastic, and cement. The first shroud may include an end cap with an inner opening dimensioned to receive the tubular string and encloses at least one end of the tubular. The end cap may include one or more of: one or more slits radiating from the opening; and threads along the circumference of the inner opening. One or more of 1) the end cap and the tubular and 2) the end cap and the tubular string may be secured to each other by one of: a weld, a fastener, a bonding agent, cement, a compression fitting, a friction fitting, and a threaded connection. The end cap may include at least one raised lip. In some aspects, the end cap may be integral to the first shroud. The embodiment may include a second shroud surrounding the one or more openings below said flow blocking device and open at a top end, wherein said one or more openings above said flow blocking device are positioned on substantially the same side on tubular string as said one or more openings below said flow blocking device, wherein the first shroud surrounds said one or more openings above said flow blocking device and comprises an opening on a side of the tubular string that is opposite the one or more openings above the flow blocking device, and wherein the first shroud is closed on both ends. The second shroud may be open at the bottom end. The system may also include a casing annular sealing device disposed in the casing and forming an annular barrier between an annulus defined by the tubular string and the casing. The casing annular sealing device may include a packer.

In some aspects, the one or more openings above said flow blocking device may be positioned on a substantially opposite side of said tubular string from the one or more openings below said flow blocking device in said tubular string and said first shroud surrounds said one or more openings below said flow blocking device in tubular string and extends a distance above the one or more openings above said flow blocking device. The first shroud may include one or more openings that surrounds the one or more openings in the tubular string above said flow blocking device in said tubular string and said first shroud is sealed around said one or more openings to reduce direct flow from inside said first shroud to said one or more openings above the flow blocking device surrounded within said at least one opening. In some aspects, the shroud may be connected to the tubular string by at least one of: a weld, cement, a bonding agent, and a gasket with compression supplied by at least one of: a screw, a bolt, and a wedge.

In aspects, the embodiment may include one or more of: a fluid displacement device disposed in or on the tubular string; a first solids collection device disposed in the tubular string and connected to the first solids collection annular sealing device, the first solids collection device comprising: a first inner tubular connected to the first solids collection annular sealing device, wherein the first inner tubular has one or more openings; a first solids collection annulus formed by the first inner tubular and the tubular string, wherein the first solids collection annular sealing device forms an annular seal between the tubular string and the first inner tubular; and a first cover disposed on an end of the first inner tubular opposite the first solids collection annular sealing device above the one or more openings in the first inner tubular, wherein the first cover is configured to redirect flow out of the one or more openings in the first inner tubular. The embodiment may also include a second solids collection device disposed in the tubular string and connected to the second solids collection annular sealing device, the second solids collection device comprising: a second inner tubular connected to the second solids collection annular sealing device, wherein the second inner tubular has one or more openings; a second solids collection annulus formed by the second inner tubular and the tubular string, wherein the second solids collection annular sealing device forms an annular seal between the tubular string and the second inner tubular; and a second cover disposed on an end of the second inner tubular opposite the second annular sealing device above the one or more openings in the second inner tubular, wherein the second cover is configured to redirect flow out of the one or more openings in the second inner tubular; wherein the first and second solids collection annular sealing devices are bushings and the flow blocking device comprises at least one of: a blind sub and a blanking plug in a seating nipple; and wherein the first solids collection device is below the casing annular sealing device and the second solids collection device is above the casing annular sealing device. The first solids collection annular sealing device and the first solids collection device may be disposed above the casing annular sealing device, and wherein the tubular string further comprising one or more openings between the first solids collection annular sealing device and the cover configured to allow flow between the first solids collection device and the casing annulus. The first cover may include one or more sections of screen configured to block at least some solids.

The embodiment may also include a bi-flow annular sealing device disposed in the tubular string below the fluid displacement device and above the solids collection device; a bi-flow inner tubular connected to the bi-flow annular sealing device and extending downward from the bi-flow annular sealing device; and a bi-flow connector disposed in the tubular string above the first solids collection device and sealingly engaged with the bi-flow inner tubular, wherein the tubular string comprises one or more openings above the bi-flow connector and below the bi-flow annular sealing device configured to allow flow between a bi-flow annulus and the casing annulus, wherein the bi-flow annulus is formed by the bi-flow inner tubular and the tubular string. The bi-flow connector may include: a tubular with a first end, a second end, an inner bore and a thickness; one or more first channels through the thickness configured to allow fluids to pass from outside the thickness to the inner bore; and one or more second channels through the thickness configured to allow fluids to pass from the first end to the second end, wherein the one or more first channels and the one or more second channels do not intersect. The one or more second channels may be aligned vertically on only one side of the bi-flow connector and the one or more openings in the tubular string above the bi-flow connector and below the bi-flow annular sealing device are aligned on a substantially opposite side of the wellbore as the one or more second channels.

In aspects, the embodiments may include a shield disposed around the tubular string, above the casing annular sealing device and below the one or more openings in the tubular string above the flow blocking device, wherein shield is dimensioned to substantially cover a surface of the casing annular sealing device. The shield may be made of at least one of: metal, cement, fiberglass, elastomer, carbon, carbon fiber, polymers, resin, ceramic, and plastic. The shield may include an end cap with an inner opening dimensioned to receive the tubular string wherein the end cap encloses at least one end of the shield The end cap may include at least one of: one or more slits radiating from the inner opening; and threads along the circumference of the inner opening. The end cap may further include a tubular shield wall. The end cap and the tubular wall and/or the shield and the tubular string may be secured to each other by a weld, a fastener, a bonding agent, cement, a compression fitting, a friction fitting, and a threaded connection. In aspects, the end cap may be an integral part of the shield.

Another embodiment according to the present disclosure is a method for separating liquids in reservoir fluids from gases and solids in a system, the system comprising: a casing disposed in the wellbore; a casing annular sealing device disposed in the casing; a tubular string extending into the casing, wherein the casing annular sealing device forms an annular barrier in an annulus between the casing and the tubular string; a flow blocking device disposed in the tubular string, wherein the tubular string further comprises: one or more openings below the flow blocking device; and one or more openings above the flow blocking device; and a first shroud comprising a tubular and surrounding at least one of the one or more openings below the flow blocking device and the one or more openings above the flow blocking device, wherein the first shroud is off-centered with respect to the tubular string and wherein the first shroud is configured to divert flow of said reservoir fluids emanating from said one or more openings below said flow blocking device away from said one or more openings above the flow blocking device; and the method comprising: diverting the flow of the reservoir fluids emanating from the said one or more openings below said flow blocking device to lengthen a flow path to said one or more openings above the flow blocking device.

Another embodiment according to the present disclosure is a system for use in a wellbore extending from the surface to a reservoir having reservoir fluids, and the wellbore containing: a casing disposed in the wellbore; a tubular string disposed in the casing; a casing annular sealing device disposed in the casing and sealingly engaged to the tubular string to form an annular barrier for a casing annulus between the casing and the tubular string; a shield disposed around the tubular string, above the casing annular sealing device, and dimensioned to substantially cover a surface of the casing annular sealing device. The shield may be made of at least one of: metal, cement, fiberglass, elastomer, carbon, carbon fiber, polymers, resin, ceramic, and plastic. The shield may include an end cap with an inner opening dimensioned to receive the tubular string wherein the end cap encloses at least one end of the shield. The end cap may include at least one of: one or more slits radiating from the inner opening; and threads along the circumference of the inner opening. The end cap may comprise a tubular shield wall. In aspects, one or more of: 1) the end cap and the tubular wall and 2) the shield and the tubular string may be secured to each other by a weld, a fastener, a bonding agent, cement, a compression fitting, a friction fitting, and a threaded connection. The end cap may be an integral part of the shield. The casing annular sealing device may include a packer.

The embodiment may also include a first solids collection device disposed in the tubular string and connected to the first solids collection annular sealing device, the first solids collection device comprising: a first inner tubular connected to the first solids collection annular sealing device, wherein the first inner tubular has one or more openings; a first solids collection annulus formed by the first inner tubular and the tubular string, wherein the first solids collection annular sealing device forms an annular seal between the tubular string and the first inner tubular; and a first cover disposed on an end of the first inner tubular opposite the first solids collection annular sealing device above the one or more openings in the first inner tubular, wherein the first cover is configured to redirect flow out of the one or more openings in the first inner tubular. In some aspects, the embodiment may include a second solids collection device disposed in the tubular string and connected to the second solids collection annular sealing device, the second solids collection device comprising: a second inner tubular connected to the second solids collection annular sealing device, wherein the second inner tubular has one or more openings; a second solids collection annulus formed by the second inner tubular and the tubular string, wherein the second solids collection annular sealing device forms an annular seal between the tubular string and the second inner tubular; and a second cover disposed on an end of the second inner tubular opposite the second annular sealing device above the one or more openings in the second inner tubular, wherein the second cover is configured to redirect flow out of the one or more openings in the second inner tubular; wherein the first and second solids collection annular sealing devices are bushings and the flow blocking device comprises at least one of: a blind sub and a blanking plug in a seating nipple; and wherein the first solids collection device is below the casing annular sealing device and the second solids collection device is above the casing annular sealing device. The first the solids collection annular sealing device and the first solids collection device may be disposed above the casing annular sealing device. The tubular string may include one or more openings between the first solids collection annular sealing device and the opposite end of the inner tubular configured to allow flow between the solids collection device and the casing annulus. The cover may include one or more sections of screen.

The embodiment may also include one or more of: a fluid displacement device disposed in the tubular string above the solids collection device; a flow blocking device disposed in the tubular string between the first fluid displacement device and the solids collection device, wherein the tubular string further comprises: one or more openings below the flow blocking device and above the first solids collection device configured to allow flow between the interior of the tubular string and the casing annulus; and one or more openings below the fluid displacement device and above the flow blocking device configured to allow flow between the casing annulus and the interior of the tubular string; and a first shroud comprising a tubular disposed in an off-centered position about the tubular string and surrounding at least one of: 1) said one or more openings below the flow blocking device and 2) the one or more openings above the flow blocking device, wherein said shroud is configured to divert the flow of said reservoir fluids emanating from said one or more openings below said flow blocking device away from said one or more openings above the flow blocking device. The first shroud may include end cap with an inner opening dimensioned to receive the tubular string and encloses at least one end of the tubular. The end cap may include at least one of: one or more slits radiating from the opening; and threads along the circumference of the inner opening. The end cap may include a raised lip. The end cap may be an integral part of the shroud. The embodiment may also include a second shroud surrounding the one or more openings below said flow blocking device and open at a top end; wherein said one or more openings above said flow blocking device are positioned on substantially the same side on tubular string as said one or more openings below said flow blocking device, wherein the first shroud surrounds said one or more openings above said flow blocking device and comprises an opening on a side of the tubular string that is opposite the one or more openings above the flow blocking device, and wherein the first shroud is closed on both ends. The second shroud may be open at the bottom end.

In some aspects, the one or more openings above said flow blocking device may be positioned on substantially the opposite side of said tubular string from the one or more openings below said flow blocking device in said tubular string and said shroud surrounds said one or more openings below said flow blocking device in tubular string and extends a distance above the one or more openings above said flow blocking device. In some aspects, the first shroud may include at least one opening that surrounds the one or more openings above said flow blocking device in said tubular string and said first shroud is sealed around said one or more openings to reduce direct flow from inside said shroud to said one or more openings above the flow blocking device surrounded within said at least one opening. The first shroud may be sealed around the tubular string about the at least one opening by at least one of: a weld, cement, a bonding agent or by a gasket with compression supplied by at least one of: a screw, a bolt, a wedge.

The embodiment may also include a bi-flow annular sealing device disposed in the tubular string below the fluid displacement device and above the first solids collection device; a bi-flow inner tubular connected to the bi-flow annular sealing device and extending downward from the bi-flow annular sealing device; and a bi-flow connector disposed in the tubular string above the first solids collection device and sealingly engaged with the bi-flow inner tubular, wherein the tubular string comprises one or more openings above the bi-flow connector and below the bi-flow annular sealing device configured to allow flow between a bi-flow annulus and the casing annulus, wherein the hi-flow annulus is formed by the bi-flow inner tubular and the tubular string. The bi-flow connector may include a tubular with a first end, a second end, an inner bore and a thickness; one or more first channels through the thickness configured to allow fluids to pass from outside the thickness to the inner bore; and one or more second channels through the thickness configured to allow fluids to pass from the first end to the second end, wherein the one or more first channels and the one or more second channels do not intersect. The one or more second channels may be aligned vertically on only one side of the bi-flow connector and the one or more openings in the tubular string above the bi-flow connector and below the bi-flow annular sealing device are aligned on a substantially opposite side of the wellbore as the one or more second channels. In aspects, the shield may surround the one or more second channels and the one or more openings above the bi-flow connector with a closed end of the shield farthest from the surface and an open end of the shield closest to the surface.

In aspects involving a bi-flow annular sealing device and a bi-flow connector, a casing annular sealing device may optionally not be installed. In this instance, the first solids collection device is below the bi-flow connector and the second solids collection device is above the first solids collection device. There may be additional solids collection devices below the bi-flow connector. A shield may be placed around the bi-flow connector with the upper end of the shield above the one or more openings in the tubular string above the bi-flow connector. The shield may have a closed end farthest from the surface that is configured to allow the passage of a tubular and an open end closest to the surface.

Another embodiment according to the present disclosure is a method of reducing an amount of solids deposited on a casing annular sealing device of a system in a wellbore, the system comprising: a casing disposed in the wellbore; a tubular string disposed in the casing; the casing annular sealing device disposed in the casing and sealingly engaged to the tubular string to form an annular barrier for a casing annulus between the casing and the tubular string; a shield disposed around the tubular string, above the casing annular sealing device, and dimensioned to substantially cover a surface of the casing annular sealing device; and the method comprising: intercepting the solids falling toward the casing annular sealing device with the shield.

Examples of the more important features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

Figure 1:
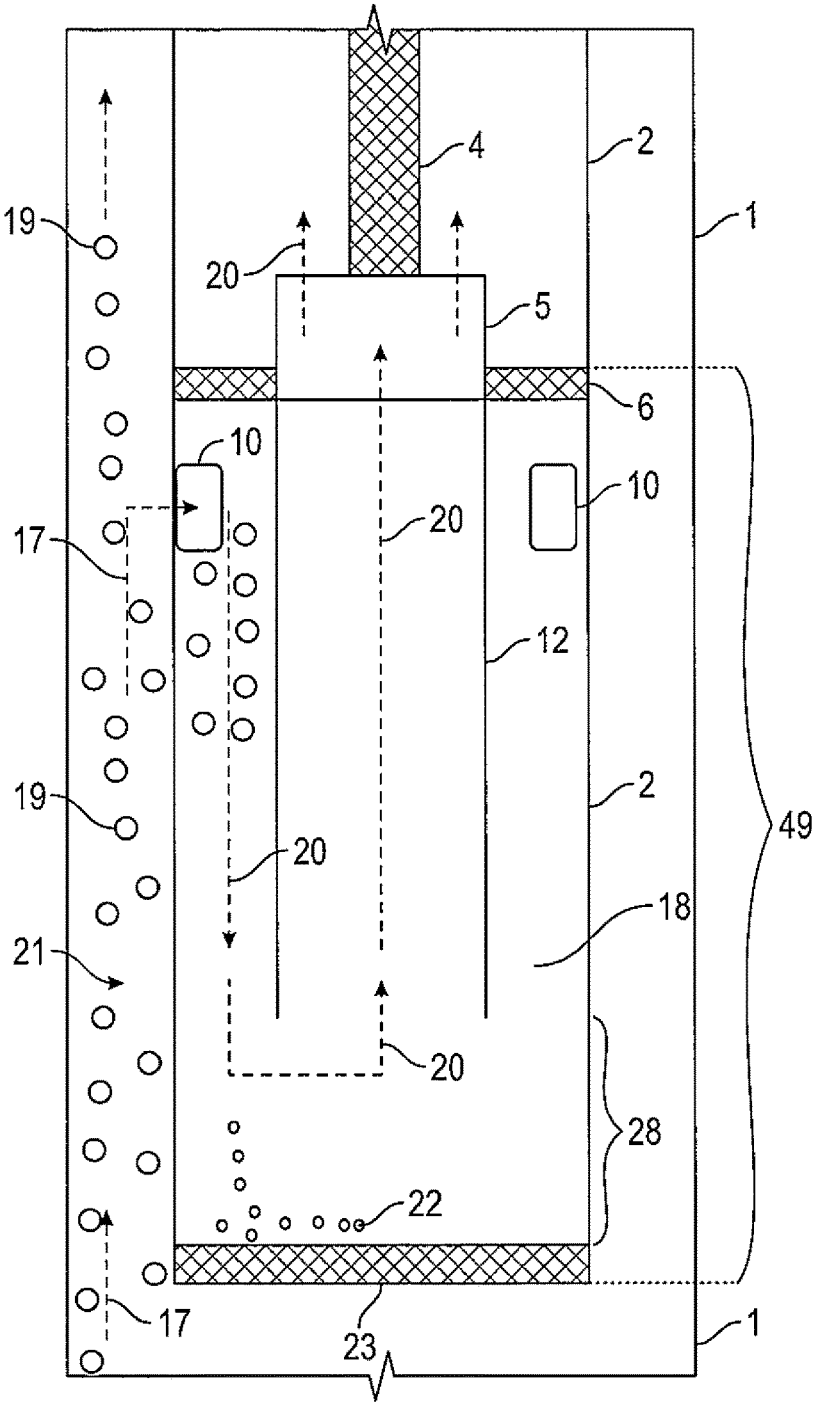
FIG. 1 (Prior Art)
FIG. 1 is a diagram of a typical down-hole separator, commonly referred to as a "poor boy separator"

Generally, the present disclosure relates to a down-hole system and method for separating gases and solids entrained in a liquid. Specifically, a system using one or more solids collection devices, shrouds, diverters, and/or shields to prevent solids and gasses from entering the fluid displacement devices or settling on down-hole equipment. The system may include a shroud and/or a diverter disposed between a reservoir fluid flow path and an intake leading to a fluid displacement device to reduce the entry of gas and solids into the fluid displacement device. The present disclosure is susceptible to embodiments of different forms.

There are shown in the drawings, and herein will be described in detail, specific embodiments of the present disclosure with the understanding that the present disclosure is to be considered an exemplification of the principles of the present disclosure and is not intended to limit the present disclosure to that illustrated and described herein.

The present disclosure proposes a gas and solids separation system that utilizes one or more shrouds and diverters to separate and direct the gas away from the intake of a fluid displacement device configured to move liquids from down-hole to the surface. Some embodiments according to the present disclosure may include a solids collection chamber or chambers and a shield or shields to trap solids in the wellbore before the solids can interfere with down-hole equipment. Herein, direction references to an upward direction, such as "up", "above", "upward", "rise" and variations thereof, refer to a direction along the wellbore toward the surface. Similarly, direction references to a downward direction, such as "down", "downward", "below", "falling", and variations thereof, refer to a direction along the wellbore away from the surface.

FIG. 1 shows a diagram of a conventional "poor boy separator" separation system 49 installed in a wellbore. The system 49 includes a tubular string 2 disposed within a casing 1. Herein, the term "tubular string" is used for production tubulars made of suitable materials for use in a down-hole well environment as would be understood by a person of ordinary skill in the art. Exemplary, but non-limiting, materials for the tubing is steel, including carbon, stainless, and nickel alloy varieties and fiberglass. The tubular string 2 and the casing 1 define a casing annulus 21 through which reservoir fluids 17 may travel upwards. Inside the tubular string 2 is an inner tubular 12, and an annulus 18 is defined by the tubular string 2 and the inner tubular 12. The inner tubular 12 is secured to the bottom of a fluid displacement device 5, which is disposed in an annular sealing device 6. The fluid displacement device 5 may be actuated by rods 4 for pumping liquids up the tubular string 2. The annular sealing device 6 may be a seating nipple or a suitable equivalent as understood by a person of ordinary skill in the art.

The tubular string 2 has one or more openings 10 allowing flow between the casing annulus 21 and the annulus 18. The one or more openings 10 are disposed below the annular sealing device 6 and above the bottom of the inner tubular 12. The bottom of the tubular string 2 may terminate in a blind sub 23 to prevent reservoir fluids 17 from entering the tubular string 2 below the one or more openings 10. This arrangement provides a path for the reservoir fluids 17 to travel and allows for separation of the liquids 20 from the gasses 19 and the solids 22 before the liquids 20 enter the intake of the fluid displacement device 5. A mud anchor 28 is formed by the gap between the bottom of the inner tubular 12 and the blind sub 23 within the tubular string 2.

In use, for FIG. 1, the system 49 is normally disposed below a tubing anchor in the wellbore. The reservoir fluids 17 travel from the reservoir up the casing 1 and into casing annulus, and some of the gas 19 separates out from the reservoir fluids 17 and travels to the surface up the casing annulus 21. Some of the gas 19 is drawn into the one or more openings 10 along with reservoir fluids 17 during the up-stroke of pump 5. The liquids 20 continue to travel down the annulus 18 and into the inner tubular 12 and travel up the inner tubular 12 into the intake of the pump 5 where the liquids 20 are pumped to the surface inside the tubular string 2. If the separator is properly sized for the designed flow rate of the pump 5, the gas 19 will not reach the end of inner tubular 12 before the end of the up-stroke of the pump 5. During the down-stroke of the pump 5, the velocity of the reservoir fluids 17 ceases and the gas 19 rises up the annulus 18 and exits the one or more openings 10 and flows to the surface up the casing annulus 21. The solids 22 entrained in the liquids 20 fall due to gravity inside the annulus 18 and become trapped in the mud anchor 28.

Figure 2:
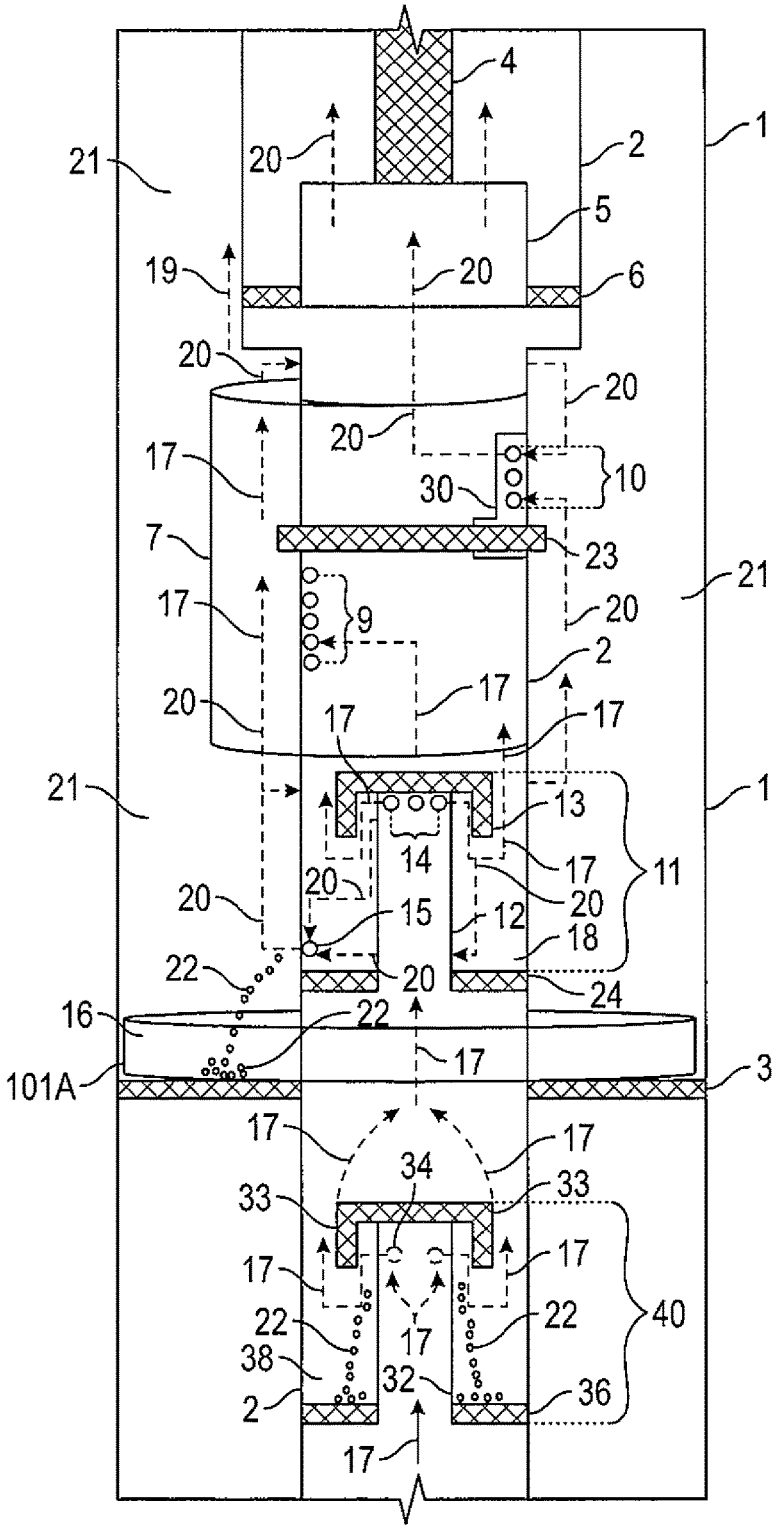
FIG. 2 is a diagram of an embodiment of the down-hole separation system with solids collection devices, a shield, and a shroud surrounding a portion of the tubing string according to the present disclosure.

FIG. 2 shows an embodiment of the gas and solids separation system of the present disclosure. The tubular string 2 is disposed in the casing 1. The casing annulus 21 is formed by the tubular string 2 and the casing 1. The casing 1 is separated into an upper portion and a lower portion by a casing annular sealing device 3. In some embodiments, the casing annular sealing device 3 may be a packer. A solids collection device 40 may be disposed in the tubular string 2 below the casing annular sealing device 3. The solids collection device 40 may include an inner tubular 32 forming an annulus 38 between the inner tubular 32 and the tubular string 2. The annulus 38 may be sealed below the inner tubular 32 by a casing solids collection annular sealing device 36. In some embodiments, the casing solids collection annular sealing device 36 may be a bushing. The inner tubular 32 may include a cover 33 to prevent flow out of the top of the inner tubular 32 and one or more openings 34 to allow flow of the reservoir fluids 17 between the interior of the inner tubular 32 and the annulus 38. The cover 33 may be positioned to redirect at least some of the flow out of the one or more openings 34 to elongate the flow path of the reservoir fluids 17 as they travel upward in the tubular string 2 above the solids collection device 40 and increase the likelihood of the solids 22 falling out. In some embodiments, the cover 33 may contain one or more sections of screen that will allow gas and liquids to flow through the screen or screens but will prevent passage of at least some of the solids and redirect these solids downward. The screen or screens may be selected to block solids with a particle size above a selected threshold. The solids collection device 40 is configured to allow at least some of the solids 22 entrained in the reservoir fluids 17 to fall out of the reservoir fluids 17 as they move through the solids collection device 40. As the solids 22 fall out, they will collect on top of the casing solids collection annular sealing device 36.

Similarly, a solids collection device 11 may be disposed in the tubular string 2 above the casing annular sealing device 3. The solids collection device 11 may include an inner tubular 12 forming an annulus 18 between the inner tubular 12 and the tubular string 2. The annulus 18 may be sealed below the inner tubular 12 by a solids collection annular sealing device 24. In some embodiments, the solids collection annular sealing device 24 may be a bushing. The inner tubular 12 may include a cover 13 to prevent flow out of the top of the inner tubular 12. The cover 13 may be disposed on the end of the inner tubular 12 opposite the solids collection annular sealing device 24. The inner tubular 12 may also comprise one or more openings 14 to allow flow of the reservoir fluids 17 between the interior of the inner tubular 12 and the annulus 18. The cover 13 may be positioned to redirect at least some of the flow out of the one or more openings 14 to elongate the flow path of the reservoir fluids 17 to one or more openings 9 in the tubular string 2 above the solids collection device 11 and increase the likelihood of the solids 22 falling out. The cover 13 may also contain one or more sections of screen similar to cover 33. The solids collection device 11 is configured to allow at least some of the solids 22 entrained in the reservoir fluids 17 to fall out of the reservoir fluids 17 as they move through the solids collection device 11. The use of two solids collection devices 11, 40 is illustrative and exemplary, as one or more solids collection devices 11, 40 may be used with the system. Additionally, the inner tubular string within the solids collection devices 11, 40 may extend below the annular sealing devices 24, 36, respectively. The tubular string 2 may optionally include at least one opening 15 located above the solids collection annular sealing device 24 and below the one or more openings 14 to allow the flow of the solids 22 and the liquids 20 into the casing annulus 21. When the at least one opening 15 is present, the solids 22 that fall out of the fluids passing through the at least one opening 15 may be collected in the shield 16.

A shield 16 with a disk or end cap 101A may be disposed in the casing 1 so as to surround the tubular string 2 above the casing annular sealing device 3 and below the at least one opening 15. The shield 16 may extend higher if the at least one opening 15 is not present. The shield 16 may be dimensioned so that it covers some, or substantially all, of the upper surface of the casing annular sealing device 3. When in place, the shield 16 may catch falling debris and prevent it from accumulating on top of the casing annular sealing device 3. The shield 16 is sized to cover the casing annular sealing device 3 but with sufficient space between the shield 16 and the casing 1 so that the shield 16 may be lifted to remove the accumulated debris. In FIG. 2, the shield 16 is shown extending upward to a point below the solids collection annular sealing device 24; however, this is exemplary and illustrative only. The shield 16 may extend from the casing annular sealing device 3 or any point below the at least one opening 15 to any point above, so long as the shield 16 is positioned to capture solids 22 that may separate from the reservoir fluids 17 coming into a casing annulus 21 formed by the space between the casing 1 and the tubular string 2 through the at least one opening 15. In some embodiments, the shield 16 may be the end cap 101A.

Above the solid collection device 11, the tubular string 2 may be divided into an upper portion and a lower portion by a blind sub 23, so that flow between the lower portion and the upper portion require a flow path out of the interior of the lower portion of the tubular string 2 and into the casing annulus 21, and, then back into the upper portion of the tubular string 2. Flow out of the lower portion may be through one or more openings 9 disposed above the first solids collection device 11 and below the blind sub 23. Flow into the upper portion of the tubular string 2 may be through one or more openings 10 disposed above the blind sub 23 and below an annular sealing device 6. The annular sealing device 6 may form a seat for placement of a fluid displacement device 5 in the tubular string 2. In this embodiment and all subsequent embodiments contained herein, the rods 4 and the annular sealing device 6 may not be installed if a fluid displacement device other than a rod pump is used. It is also contemplated that the rods 4 may comprise a tubular that provides a conduit for a cable or cables or a pathway for liquids 20 to travel to the surface.

A shroud 7 may be disposed in the casing 1 around the tubular string 2 and surround the one or more openings 9. The shroud 7 may be off-centered around the tubular string 2 away from the one or more openings 9. The shroud 7 may have one or more openings 30 to allow flow through the one or more openings 10. The one or more openings 9 may be disposed substantially on the opposite side of the tubular string 2 from the one or more openings 10. In some embodiments, the shroud 7 directs the flow of fluids upward on only one side of the wellbore. The shroud 7 may prevent the movement of the liquids 20 toward the wall of the casing 1, which may be curved and deflect the liquids 20 to undesired directions or remix the liquids 20 with the gas 19 or the solids 22 after the liquids exit the one or more openings 9. The shroud 7 may be dimensioned based on the size of the wellbore and the size of the tubular string 2. For example, the shroud 7 may have a 3½ inch (8.9 cm) diameter with a tubular string 2 outer diameter of 2⅜ inches (6.03 cm) and be installed in a casing 1 as small as 4½ inches (11.43 cm) in diameter. Additionally, the tubular string 2 may be tapered with varying outer diameters. It is also contemplated that, of the openings in the tubular string 2, the shroud 7 may surround only the one or more openings 10 in a centered or off-centered position.

In operation, for FIG. 2, reservoir fluids 17 travel up tubular string 2 and enter the inner tubular 32 of the solids collection device 40. The solids collection device 40 changes the flow direction of the reservoir fluids 17 to facilitate separation of the gas 19 and the solids 22 from the reservoir fluids 17. Some of the solids 22 may fall out as the reservoir fluids 17 travel into the annulus 38 via the at least one openings 34 and around the cover 33. The reservoir fluids 17 then continue to travel upward in the tubular string 2 through the casing annular sealing device 3. Once above the casing annular sealing device 3, the reservoir fluids 17 enter the solids collection device 11, where, similarly, the reservoir fluids 17 travel up the interior of the inner tubular 12, through at least one opening 14, and into the annulus 18 while the remaining reservoir fluids 17 continue to travel up the tubular string 2 and the liquids 20 and the solids 22 travel into the casing annulus 21 through the at least one opening 15. The solids 22 entrained in the liquids 20 may fall out into the shield 16, while the liquids 20 may reenter the tubular string 2 through the one or more openings 10. As travel upward continues, the amount of solids 22 in the reservoir fluids 17 will decline as the solids 22 fall out.

The reservoir fluids 17 traveling above the solids collection device 11 are redirected to the one or more openings 9 by the blind sub 23. Upon exiting the tubular string 2 through the one or more openings 9, the reservoir fluids 17 may separate the liquids 20 from the gas 19, and the liquids 20 may re-enter the tubular string 2 through the one or more openings 10. As the gas 19 exits the top of the shroud 7, its velocity carries the gas 19 upward in the casing annulus 21. In order for the gas 19 to reach the intake of the fluid displacement device 5 to interfere with the effectiveness of the fluid displacement device 5, the gas 19 would need to be drawn downward through the larger cross-sectional area of the casing annulus 21. The larger cross-sectional area in the casing annulus 21 above the shroud 7 compared with the cross-sectional area between the shroud 7 and the tubular string 2 reduces the likelihood of the gas 19 entering the intake of the fluid displacement device 5. In summary, the liquids 20 have several paths of flow. The liquids 20 can either travel up and out of the top of the shroud 7 from the one or more openings 9 and travel to the opposing side of the wellbore to enter the one or more openings 10, or travel down and out of the bottom of the shroud 7 and then travel to the opposing side of the wellbore to enter the one or more openings 10, or the liquids 20 may travel through the at least one opening 15 and up the casing annulus 21 to the opposite side of the wellbore to enter the one or more openings 10. Regardless, the distance that the liquids 20 must travel to the opposing side of the wellbore gives the gas 19 more time to separate out from the liquids 20 during the brief period of time of the upstroke of the fluid displacement device 5. The liquids 20 that reenter the tubular string 2 through the one or more openings 10 are pumped to the surface by the fluid displacement device 5, which is driven by the rods 4. In some embodiments, the cross-sectional area of the casing annulus 21 above the shroud 7 may be about 15 times the cross-sectional area of a conventional separator in the same wellbore. In an exemplary embodiment using a 5½ inch (13.97 cm) casing, this equates to a maximum rate of gas free liquids 20 to the fluid displacement device 5 of about 700 barrels per day (111 cubic meters per day) compared with 52 barrels per day (8.27 cubic meters per day) using a suitable conventional separator (2⅜ inches×1.66 inches (6.02 cm×4.22 cm) and a maximum fluid velocity of 6 inches per second (15.24 cm per second).

Figure 3:
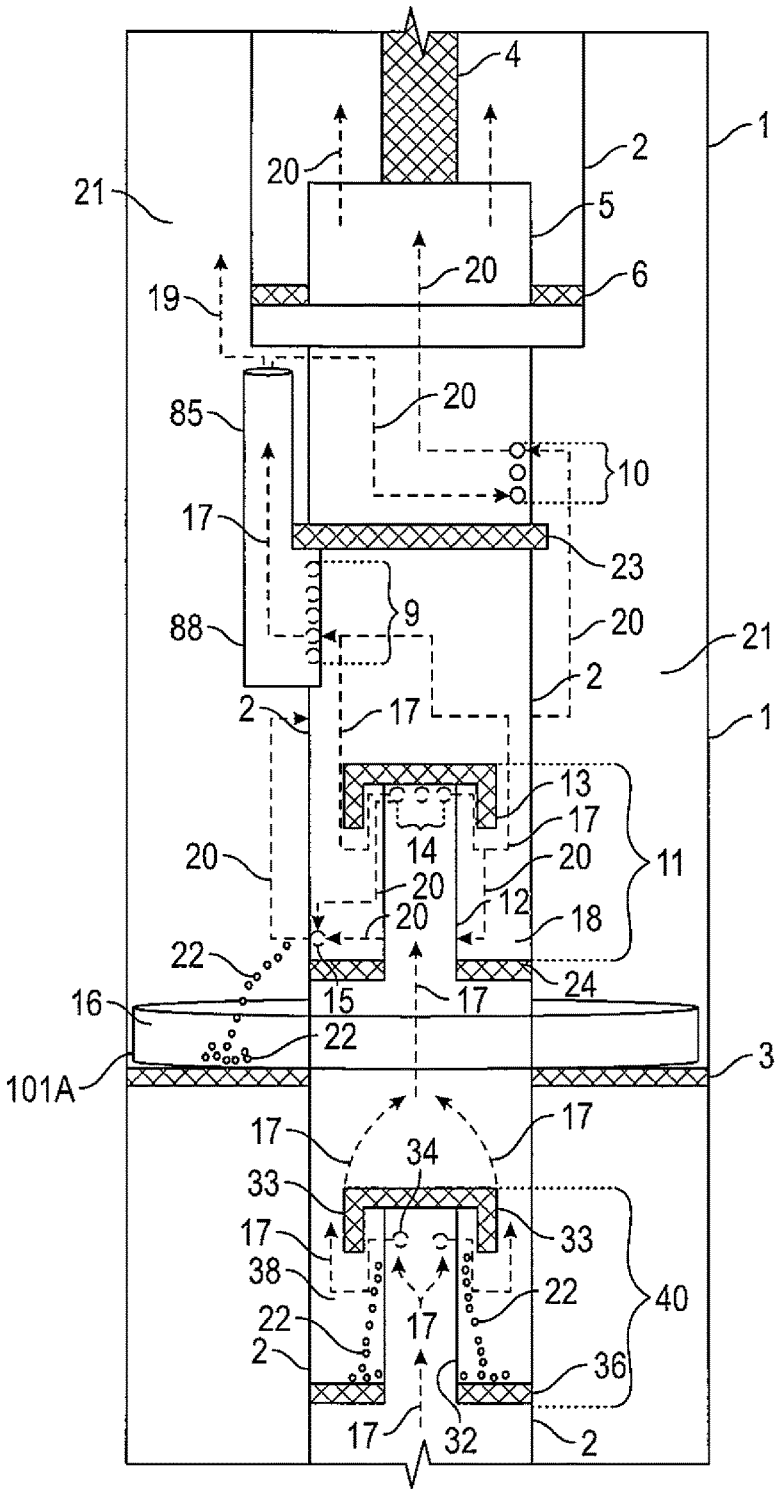
FIG. 3 is a diagram of another embodiment of the down-hole separation system with a diverter and vent attached to the tubing string according to the present disclosure.

FIG. 3 shows another embodiment of the gas and solids separation system of the present disclosure similar to FIG. 2; however, the shroud 7 of FIG. 2 is replaced by a diverter 88. The diverter 88 surrounds the one or more openings 9 and redirects the flow of the reservoir fluids 17 upward. The redirected flow exits the diverter 88 from a vent 85 that extends a distance above the one or more openings 10. The distance above may be determined by calculating the fluid velocity induced by the fluid displacement device and the cross-sectional area of the casing annular area around the vent 85. In some embodiments, the distance above the one or more opening may be about 36 inches (91.44 cm). Additionally, tubular string 2 may be tapered with varying outer diameters.

In operation, for FIG. 3, the flow of the reservoir fluids 17 out of the one or more openings 9 is redirected upward and away from the casing 1 and one or more openings 10. Upon exiting the vent 85, the gas 19 may travel up the casing annulus 21, while the liquids may fall and reenter the tubular string 2 through the one or more openings 10. In some embodiments, the diverter 88 may be closed at the bottom so as to not permit the downward flow of the liquids 20 in the diverter 88; however, it is contemplated that in other embodiments of FIG. 3, the diverter 88 is open at the bottom to allow the liquids 20 to flow out of the bottom of diverter 88.

Figure 4:
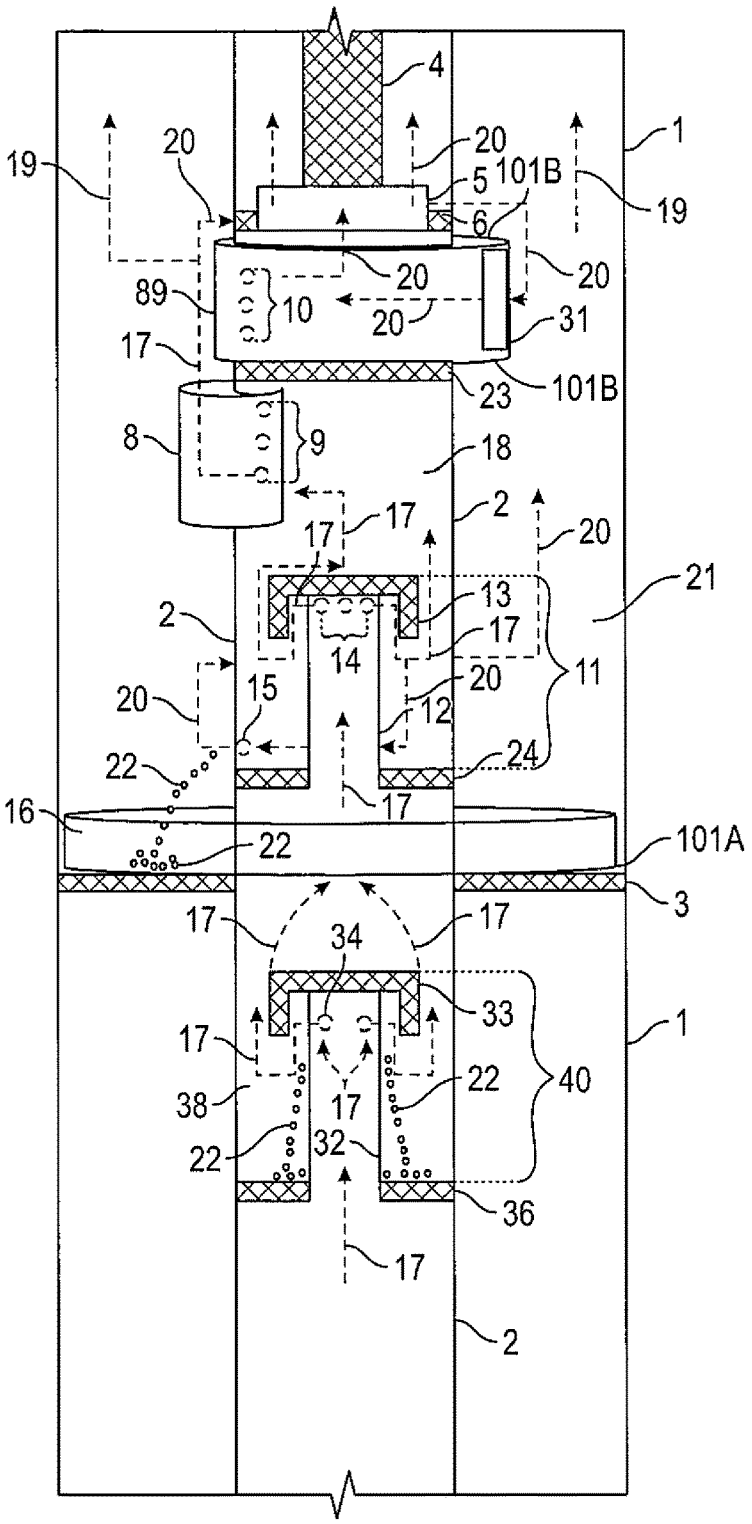
FIG. 4 is a diagram of an embodiment of the down-hole separation system with a diverter attached to the tubing string and a shroud surrounding a portion of the tubing string according to the present disclosure.

FIG. 4 shows another variant of the embodiment of FIG. 2; however, the shroud 7 is replaced by a diverter 8 and a shroud 89. The diverter 8 covers the one or more openings 9 to redirect the reservoir fluids 17 exiting the one or more openings 9. The diverter 8 may be closed or open at the bottom. When the bottom of the diverter 8 is closed, the reservoir fluids 17 may only be redirected upward, however, when the bottom of the diverter 8 is open, the liquids 20 in the reservoir fluids 20 may flow out of the bottom of the diverter 8. The shroud 89 surrounds the tubular string 2 so as to cover the one or more openings 10. The shroud 89 may include one or more openings 31 substantially on the opposite side of the one or more openings 10. The shroud 89 may include end caps 101B on the top and bottom to prevent or reduce flow into the shroud 89 through a path other than through the opening 31. The end caps 101B may be the same or a different configuration from the end cap 101A. As shown, the one or more openings 9 and the one or more openings 10 are disposed on substantially the same side of the tubular string 2, in contrast to FIGS. 2 and 3. Additionally, the tubular string 2 may be tapered with varying outer diameters. The shroud 89 may be in a centered or off-centered position around the tubular string 2.

In operation, for FIG. 4, the reservoir fluids 17 exiting through the one or more openings 9 are redirected upward and away from the casing 1 and the one or more openings 10 by the diverter 8. During the upward travel, the reservoir fluids 17 separate into the gas 19, which continues upward in the casing annulus 21, and the liquids 20, which flow into the one or more openings 10 through the one or more openings 31 in the shroud 89. The end caps 101B of the shroud 89 force the flow of the reservoir fluids 17 from the diverter 8 into the one or more openings 31.

Figure 5:
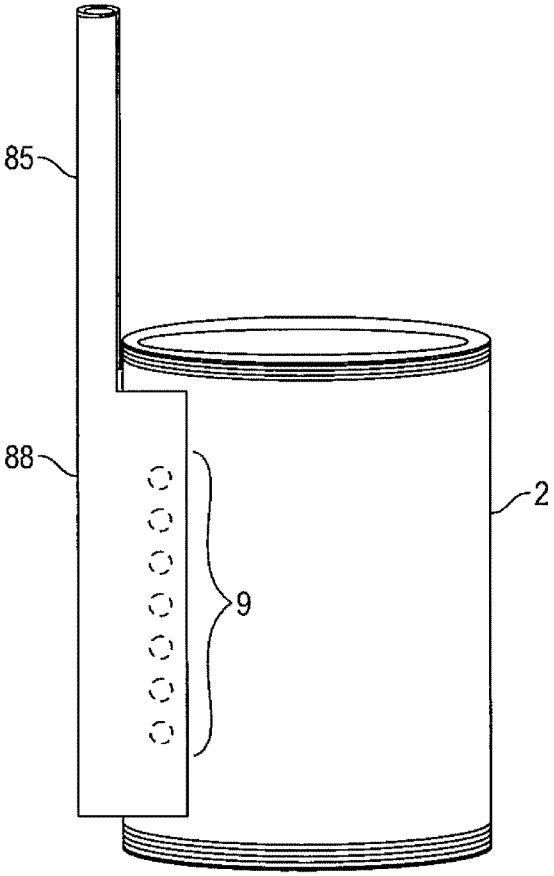
FIG. 5 is a 3D view of the diverter and vent of FIG. 3 attached to the tubing string.

FIG. 5 shows a diagram of a portion the tubular string 2 with a diverter 88 attached from FIG. 3. The diverter 88 and the vent 85 may be made of metal and other suitable materials as understood by a person of ordinary skill in the art. In some embodiments, the diverter 88 may be attached to the tubular string 2 by a weld.

Figure 6A:
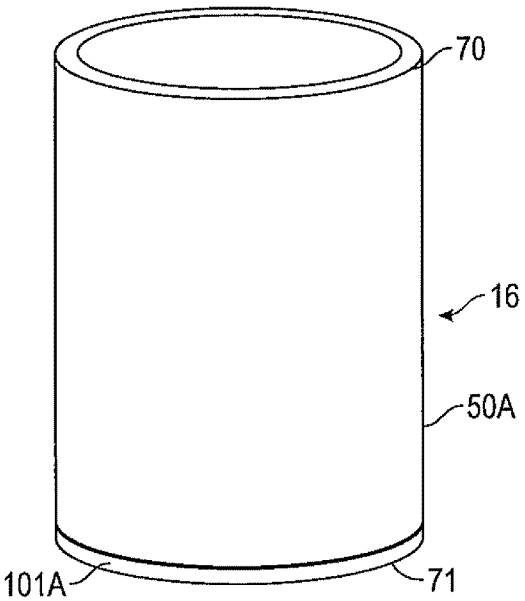
FIG. 6A is a 3D view of a shield for use in some embodiments of the present disclosure.

FIG. 6A shows a 3D view illustrating the shield 16 shown in FIGS. 2-4 and 12A. The shield 16 may include a tubular wall 50A with an open upper end 70 and a lower end 71. The lower end 71 has the end cap 101A installed to close the shield 16. The shield 16 may be made of at least one of: metal, fiberglass, elastomer, carbon, cement, polymers, resin, ceramic, plastic or other suitable material for downhole conditions. In some embodiments, the end cap 101A may be an integral part of the shield 16.

Figure 6B:
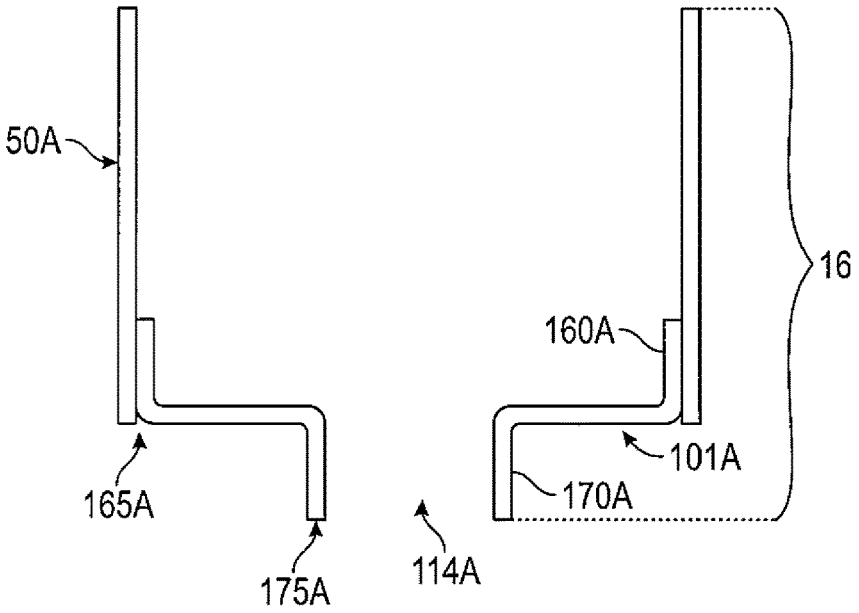
FIG. 6B is a side view of another shield for use in some embodiments of the present disclosure showing a disk win an opening and a lip portion on each of the inner and outer circumferences.

FIG. 6B shows a side view of another embodiment of shield 16 with an end cap 101A that includes an optional raised lip 160A along some or all of its outer circumference 165A, configured to overlap with at least part of the tubular wall 50A. The raised lip 160A may slide over the outer diameter of the tubular wall 50A and be secured to the tubular wall 50A with at least one of: a friction fitting, threaded connection, elastomer gaskets, a fastener or fasteners, a bonding agent, weld, clamp or other suitable fastening or attachment means known to a person of ordinary skill in the art. The end cap 101A may be dimensioned so that the optional raised lip 160A may be inserted inside the inner diameter of the tubular wall 50A and secured to the tubular wall 50A in the same fashion. In some embodiments, the tubular wall 50A may include an optional slit to reduce the force needed to compress or crimp the tubular wall 50A to the raised lip 160A. Similarly, the end cap 101A may include an optional raised lip 170A along the inner circumference of the opening 114A that may be secured to the tubular string 2 with at least one of: a friction fitting, threaded connection, elastomer gaskets, a fastener or fasteners, a bonding agent, weld, clamp or suitable fastening or attachment means known to a person of ordinary skill in the art.

Figure 6C:
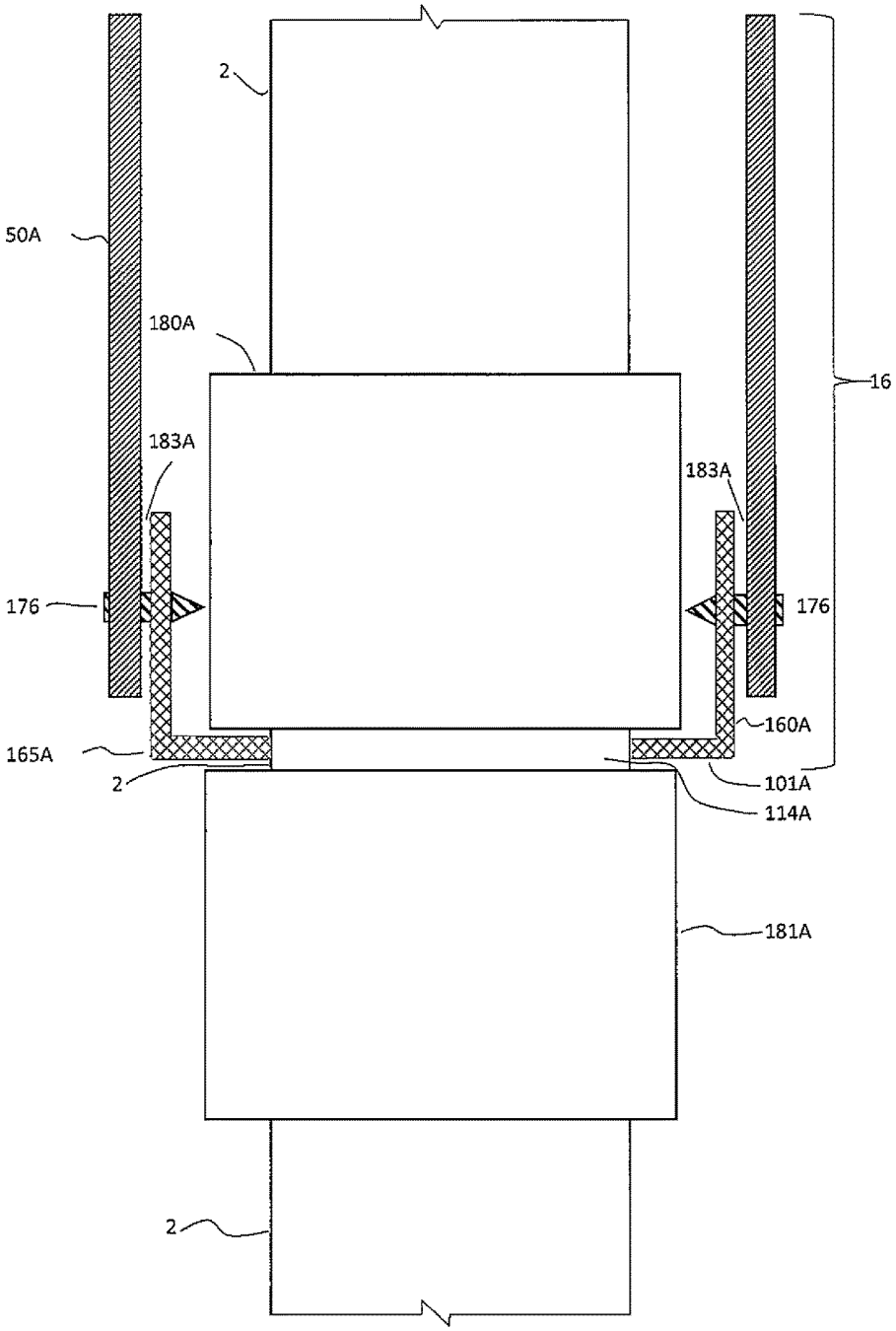
FIG. 6C is a view of a connection of a shield for use in some embodiments of the present disclosure.

FIG. 6C is a view of another embodiment of the shield 16 showing a connection between the end cap 101A with the raised lip 160A along some or all its outer circumference 165A but without the raised lip 170A. The tubular string 2 is connected to a pair of connection collars 180A, 181A. The connection collars 180A, 181A are disposed on either side of the opening 140A along the tubular string 2 and are dimensioned to not pass through the opening 114A. When the connection collars 180A and 18A are tightened to the tubular string 2 on opposite sides of the end cap 101A, the end cap 101A is prevented from moving along the tubular string 2, and is, thus, secured along the tubular string 2 between the connection collars 180A, 181A. The connection collars 180A, 181A may be tightened to hold the end cap 101A firmly in position or allow the end cap 101A to have a degree of movement along the tubular string 2. One or more fasteners 176 may secure the tubular wall 50A to the raised lip 160A. In some aspects, a gap 183A may be formed between the tubular wall 50A and the raised lip 160A. When present, the gap 183A may be filled with a gasket or a bonding agent to prevent leakage through the gap 183A and may render the fasteners 176 as optional. The end cap 101A may be dimensioned so that the optional raised lip 160A may be inserted inside the inner diameter of the tubular wall 50A and secured to the tubular wall 50A in the same fashion.

In operation, for FIGS. 6A, 6B, and 6C the shield 16 is disposed above the casing annular sealing device 3 as shown in FIGS. 2-4 and 12A to trap the solids 22 before they settle on top of the casing annular sealing device 3.

Figure 7:
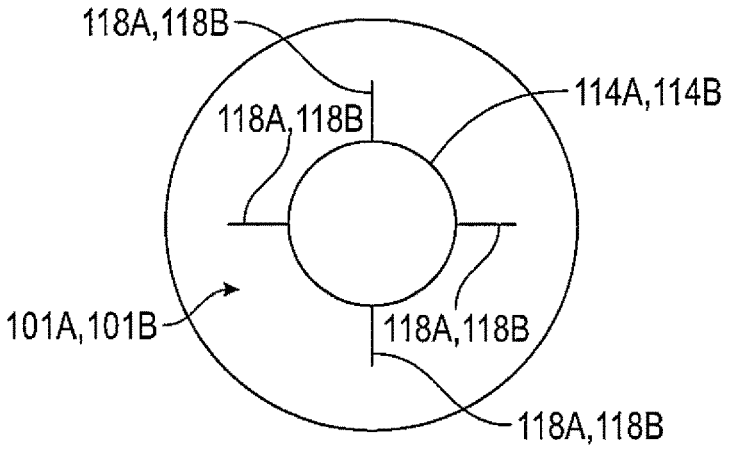
FIG. 7 is a top view of an end cap for the shield.

FIG. 7 shows a top view of the end cap or disk 101A, 101B. The disk 101A, 101B may include an opening 114A, 114B, and the opening 114A, 114B may be centered or off-centered relative to the disk 101A, 101B. The disk 101A, 101B is shown as substantially circular but its shape may vary dependent on the shape of the wellbore as would be understood by a person of ordinary skill in the art. The disk 101A, 101B may be made of at least one of metal, fiberglass, elastomer, carbon, carbon fiber, polymers, resin, ceramic, plastic, or other suitable material. The opening 114A, 114B is sized so that the disk 101A, 101B can receive the tubular string 2. The disk 101A, 101B may sealingly or non-sealingly engage the tubular string 2. Radiating from the opening 114A, 114B into the circular disk 101A, 101B is shown an optional plurality of slits 118A, 118B. While the disk 101A, 101B is shown with four slits 118A, 118B radiating from the opening, one or more slits 118A, 118B may be used. The slits 118A, 118B are shown extending about halfway through each of the disks 101A, 101B however, the slits 118A, 118B may extend further or lesser as needed to part sufficiently when receiving and engaging a tubular. It is also contemplated for the disk 101A, 101B to contain more than one opening 114A, 114B to accommodate multiple tubular strings. When multiple tubular strings are present, there may be multiple openings 114A, 114B in the disk 101A, 101B to allow passage of the multiple tubular strings. At least one of the openings 114A, 114B in end cap 101A, 101B may also contain threads in order that disk 101A, 101B may be connected to the tubular string 2 so that it may be secured in place. It is also contemplated that the end cap 101A, 101B may include an optional raised lip 160A, 160B (see FIGS. 6B and 10B) on the outer circumference of the end cap 101A, 101B for securing the end cap 101A, 101B to the tubular wall 50A, 50B and/or an optional raised lip 170A, 170B on the inner circumference of the end cap 101A, 101B for securing the end cap 101A, 101B to the tubular string 2.

Figure 8:
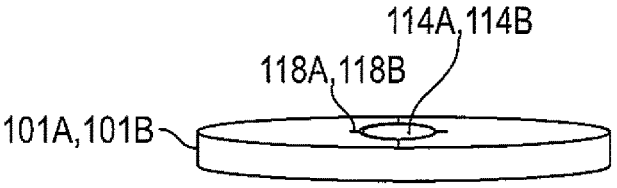
FIG. 8 is a 3D view of the end cap.

FIG. 8 shows a 3-D view of the disk 101A, 101B. In some embodiments, the slits 118A, 118B are optional. As stated previously, in some embodiments, the opening 114A, 114B in disk 101A, 101B may contain threads or an upper tubular wall and a lower split tubular wall.

In operation, for FIG. 8, appropriately sized disks 101A, 101B may be placed under, in, or around the lower end 71 of the shield 16. It is also contemplated that disk 101A, 101B be an integral part of shield 16. The disk 101A, 101B keeps the solids 22 from exiting out of the bottom of the shield 16 once the tubular string 2 is installed through the opening 114A, 114B. The slits 118A, 118B in each of the end caps 101A, 101B allow larger diameter tubing couplings to pass through disk 101A, 101B, if needed, while still providing a sufficient seal against the main body of the tubular string 2.

Figure 9:
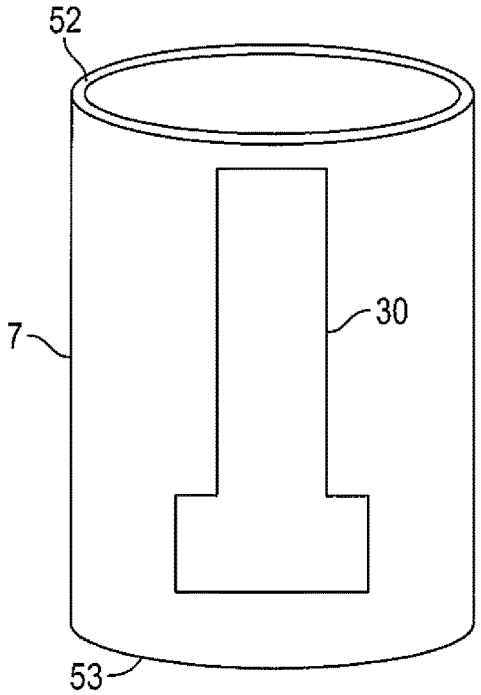
FIG. 9 is a 3D view of the shroud from FIG. 2.

FIG. 9 shows a 3D view of the shroud 7 used in FIG. 2. The shroud 7 may be tubular in shape with an upper end 52 and a lower end 53. The shroud 7 includes one or more openings 30 that, when disposed on the tubular string 2, may be positioned to allow flow into the tubular string 2 through the one or more openings 10. The one or more openings 30 is shown as T-shaped, but this is exemplary and illustrative only, as other shapes may be used so long as flow through the one or more openings 10 is permitted. The one or more openings 30 may also receive the coupling of the blind sub 23. The shroud 7 may be made from at least one of: metal, fiberglass, elastomer, carbon, carbon fiber, polymers, resin, ceramic, plastic, or other suitable material.

In operation, for FIG. 9, the shroud 7 is disposed around tubing 2 in an off-centered position to allow openings 10 and the coupling of blind sub 23 to align with the one or more openings 30. A seal may be formed between the one or more openings 30 and the tubing 2 and the blind sub 23 to prevent gas from escaping from inside the shroud 7 through the one or more openings 30 and into the one or more openings 10. The seal between the shroud 7 and the tubing 2 around the one or more openings 30 may comprise one or more of: a gasket, a bonding agent, cement, a weld, or other suitable sealing material. It is also contemplated that the shroud 7 may contain an end cap 101B (not shown) on bottom to prevent flow from entering through the bottom of shroud 7. It is also contemplated that end cap 101B will be secured in a similar fashion as disk 101A in the shield 16 (see FIGS. 6A-6C) and end cap 101B in shroud 89 (see FIG. 10A-10C). It is contemplated that the end caps 101A, 101B may be secured to their respective shield 16 or shroud 7, 89 using different securing methods or devices.

Figure 10A:
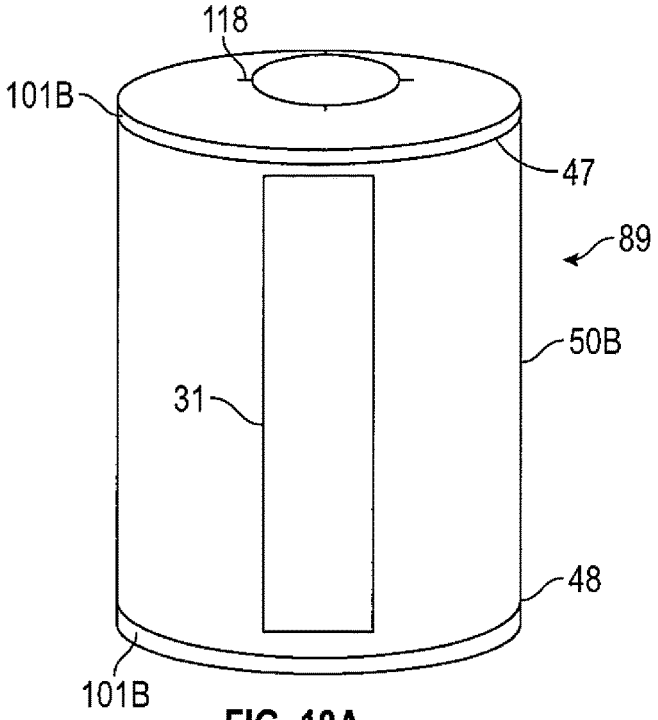
FIG. 10A is a 3D view of the shroud from FIG. 4.

FIG. 10A shows a 3D view of the shroud 89 from FIG. 4. The shroud 89 may be tubular in shape and include a tubular wall 50B with an upper end 47 and lower end 48. The shroud 89 may also include one or more of the end caps 101B to cover one or both of the upper end 47 and the lower end 48. The shroud 89 may also include one or more openings 31. The shroud 89 may be made of at least one of: metal, fiberglass, elastomer, carbon, polymers, resin, cement, ceramic, plastic, or other suitable material. In some embodiments, the end caps 101B may be an integral part of the shroud 89 or it may slide over the outer diameter of the shroud 89 and secured by one or more of: compression fitting, a friction fitting, threaded connection, elastomer gaskets, a fastener or fasteners, a bonding agent, weld, clamp or other suitable methods understood by persons of ordinary skill in the art. The end cap 101B may also be inserted inside the shroud 89 and secured in the same fashion. The end cap 101B may also be connected to the tubular wall 50B by threads in the inner opening 114B of the end cap 101B. The shroud 89 may also be secured to the tubular wall 50B by, but not limited to, a bolt or screw.

Figure 10B:
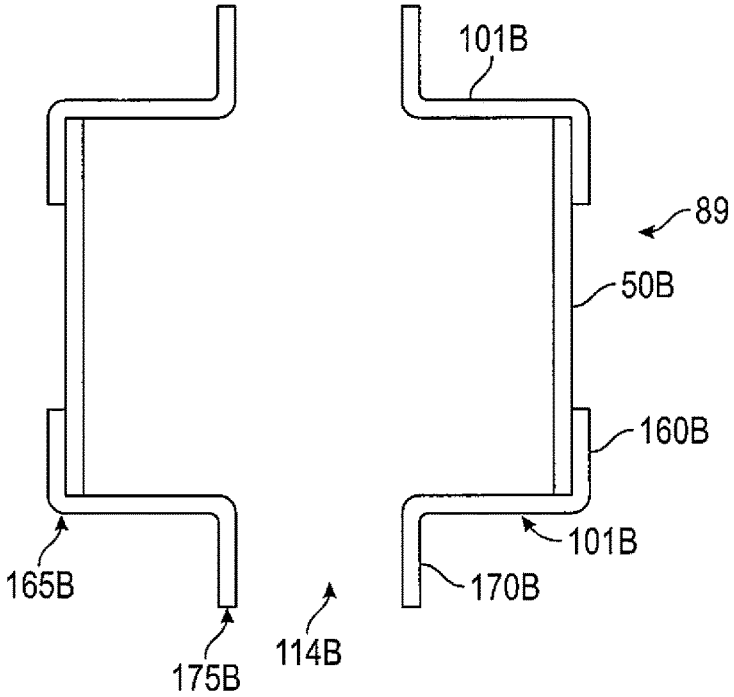
FIG. 10B is a side view of an alternative shroud for FIG. 4.

FIG. 10B shows a side view of another embodiment of the shroud 89 with an end cap 101B that includes an optional raised lip 160B along some or all of its outer circumference configured to overlap with at least part of the tubular wall 50B. The raised lip 160B may slide over the outer diameter of the tubular wall 50B and be secured to the tubular wall 50B with at least one of: a friction fitting, threaded connection, elastomer gaskets, a fastener or fasteners, a bonding agent, weld, clamp or other suitable fastening or attachment means known to a person of ordinary skill in the art. In some embodiments, the end cap 101B may be dimensioned so that the optional raised lip 160A may be inserted inside the inner diameter of the shroud 89 and secured to the shroud 89 in the same fashion. In some embodiments, the tubular wall 50B may include an optional slit to reduce the force needed to compress or crimp the tubular wall 50B to the raised lip 160B. Similarly, the end cap 101B may include an optional raised lip 170B along the inner circumference of the opening 114B that may be secured to the tubular string 2 with at least one of: friction, elastomer gaskets, screws, bolts, a bonding agent, weld, clamp or suitable fastening or attachment means known to a person of ordinary skill in the art.

Figure 10C:
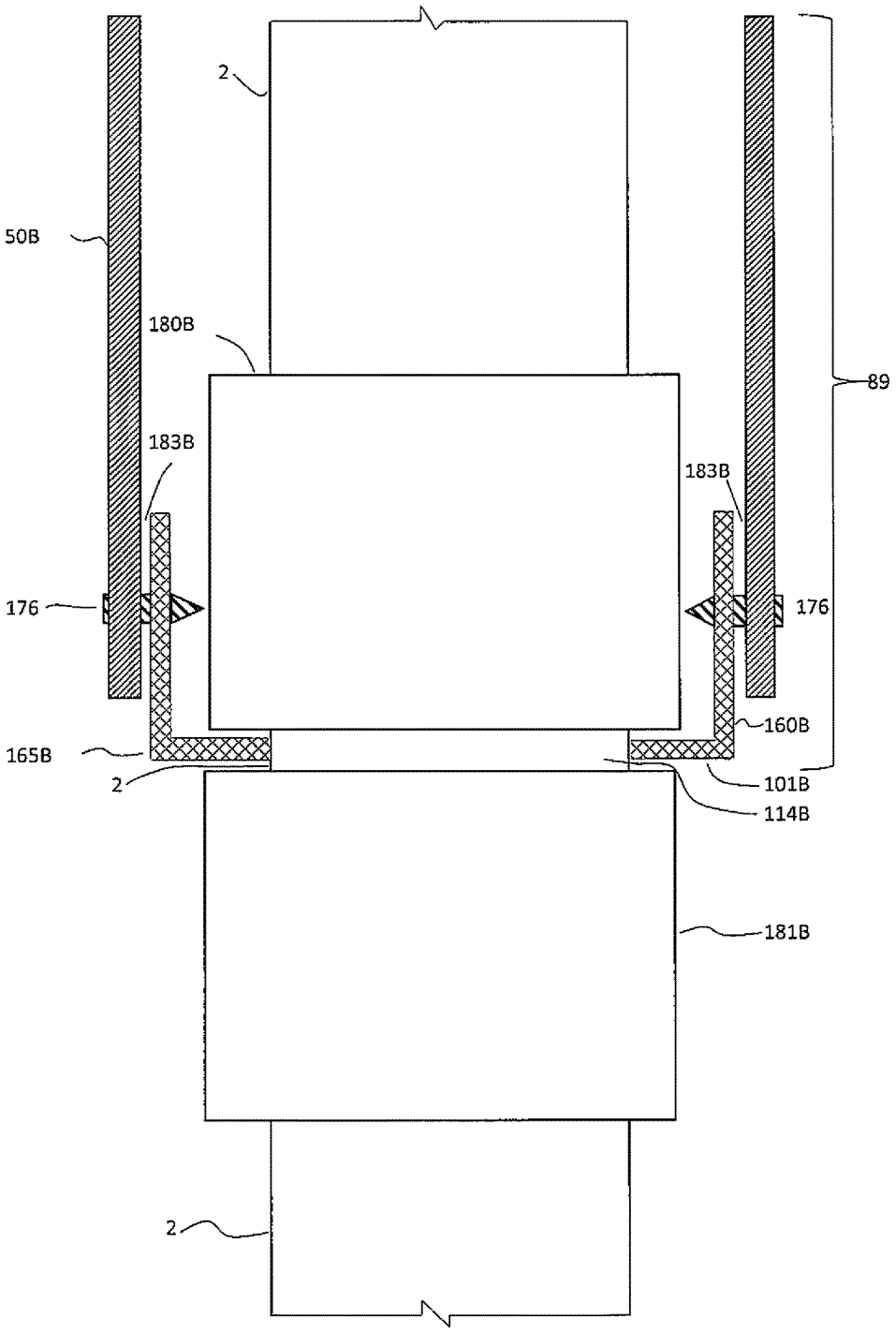
FIG. 10C is a view of a connection of a shroud for use in some embodiments of the present disclosure.

FIG. 10C is a view of another embodiment of the shroud 89 showing a connection between the end cap 101B with the raised lip 160B along some or all its outer circumference 165B but without the raised lip 170B. The tubular string 2 is connected to a pair of connection collars 180B, 181B. The connection collars 180B, 181B are disposed on either side of the opening 140B along the tubular string 2 and are dimensioned to not pass through the opening 114B. When the connection collars 180B and 181B are tightened to the tubular string 2 on opposite sides of the end cap 101B, the end cap 101B is prevented from moving along the tubular string 2, and is, thus, secured along the tubular string 2. The connection collars 180B, 181B may be tightened to hold the end cap 101B firmly in position or allow the end cap 101B to have a degree of movement along the tubular string 2 between the connection collars 180B, 181B. One or more fasteners 176 may secure the tubular wall 50B to the raised lip 160B. In some aspects, a gap 183B may be formed between the tubular wall 50B and the raised lip 160B. When present, the gap 183B may be filled with a gasket or a bonding agent to prevent leakage through the gap 183B and may render the fasteners 176 as optional. The end cap 101B may be dimensioned so that the optional raised lip 160B may be inserted inside the inner diameter of the tubular wall 50B and secured to the tubular wall 50B in the same fashion. In some aspects, the shroud 7 of FIG. 2 may be connected to the tubular 2 in the same fashion as the shroud 89 as described above.

In operation, for FIGS. 10A, 10B, and 10C, the shroud 89 is disposed around the tubular string 2 in an off-centered position to allow space for reservoir fluids 17 in the casing annulus 21 to flow around the shroud 89 from below to above. When positioned with the tubular string 2 through the one or more openings 114B of the respective end caps 101B, the liquids 20 in the reservoir fluids 17 may flow into the shroud 89 through the one or more openings 31. The shroud 7 in FIG. 2 is installed around one or more openings 9, the shroud 89 in FIG. 4 is installed around the one or more openings 10, and the shroud 7 in FIG. 12B is installed around the one or more openings 100. Since shrouds 7 and 89 are decentralized around tubular string 2, opening 114B will be in an off-centered position in end cap 101B.

The shrouds 7 and 89 may be structurally similar to the shield 16 in some embodiments. It should be noted that the shrouds 7, 89 are disposed to redirect flow paths out of one or more openings while the shield 16 is disposed to capture falling solids and prevent accumulations of the solids on components below the shield 16. In some instances, the shroud 7, 89 may be structurally identical to the shield 16, which means that some embodiments of the shroud 7, 89 and the shield 16 may be positioned within the system such that they individually capture solids and redirect a flow path. However, embodiments of the shield 16 will always include an end cap 101A that is not on top of a tubular wall 50A (if present), and the shroud 7, 89 will always include a tubular wall 50B.

Figure 11:
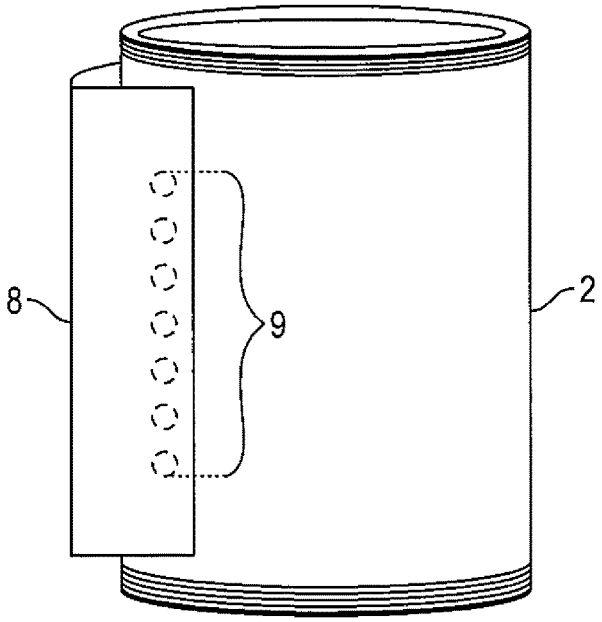
FIG. 11 is a 3D view of the diverter from FIG. 4.

FIG. 11 shows a 3D view of the diverter 8 of FIG. 4 disposed on a portion of the tubular string 2. The diverter 8 is attached to the tubular string 2 so that the diverter 8 covers the one or more openings 9. The diverter 8 may be closed on the bottom so that an upward flow path is created from the one or more openings 9 along the tubular string 2. The diverter 8 may be metal or other suitable material and is connected to outer tubing 2 by a weld or other suitable means understood by a person of ordinary skill in the art. It is also anticipated that the bottom of diverter 8 may be left open.

In operation, for FIG. 11, the diverter 8 is attached to the tubular string 2 and redirects the flow of the reservoir fluids 17 out of the tubular string 2 through the one or more openings 9 to an upward direction, if the lower end of the diverter 8 is closed. If the diverter 8 is open on bottom, then the reservoir fluids 17 may take the path of least resistance.

Figure 12A:
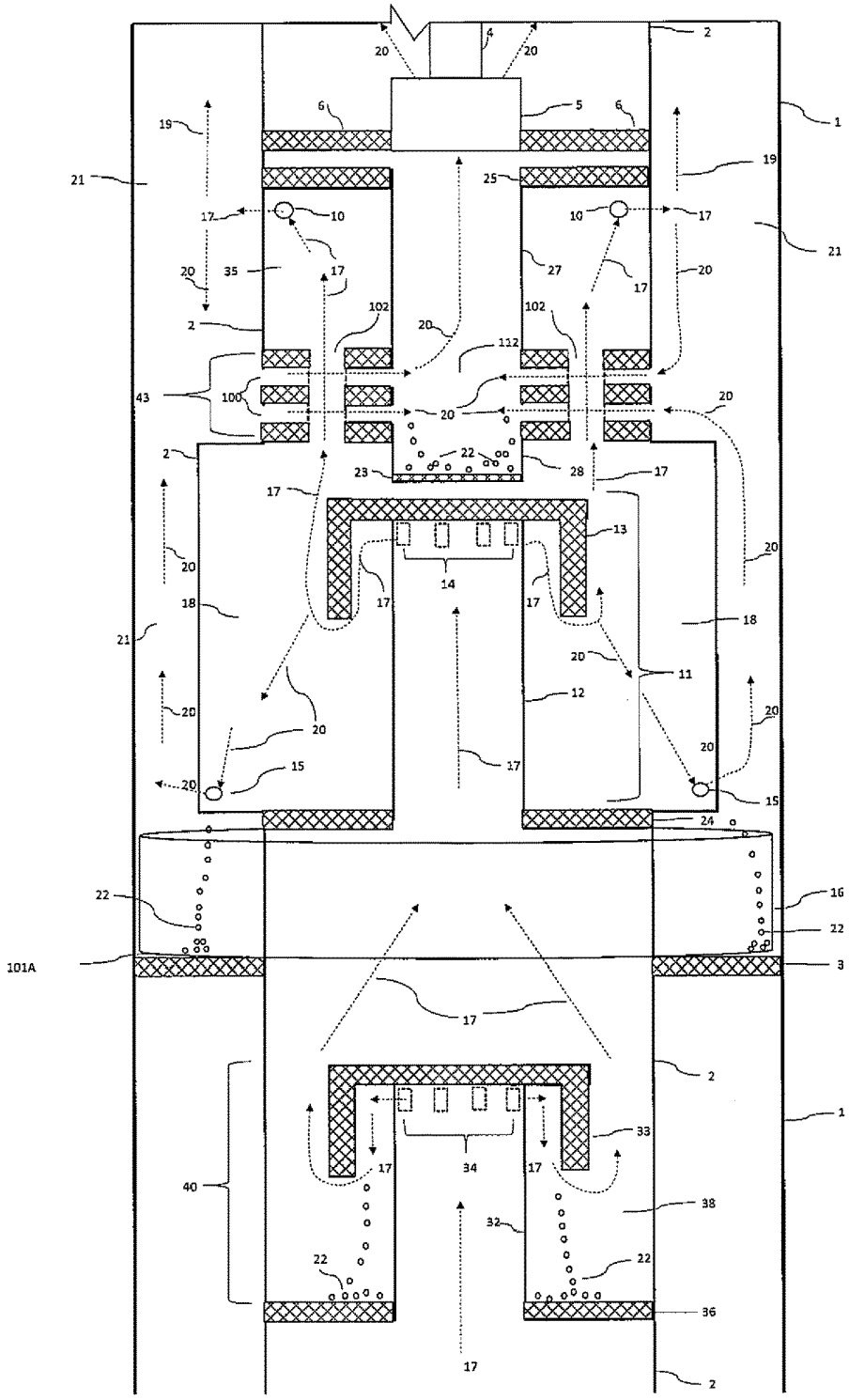
FIG. 12A is a diagram of an embodiment of the down-hole separation system with a bi-flow connector according to present disclosure.
Figure 12B:
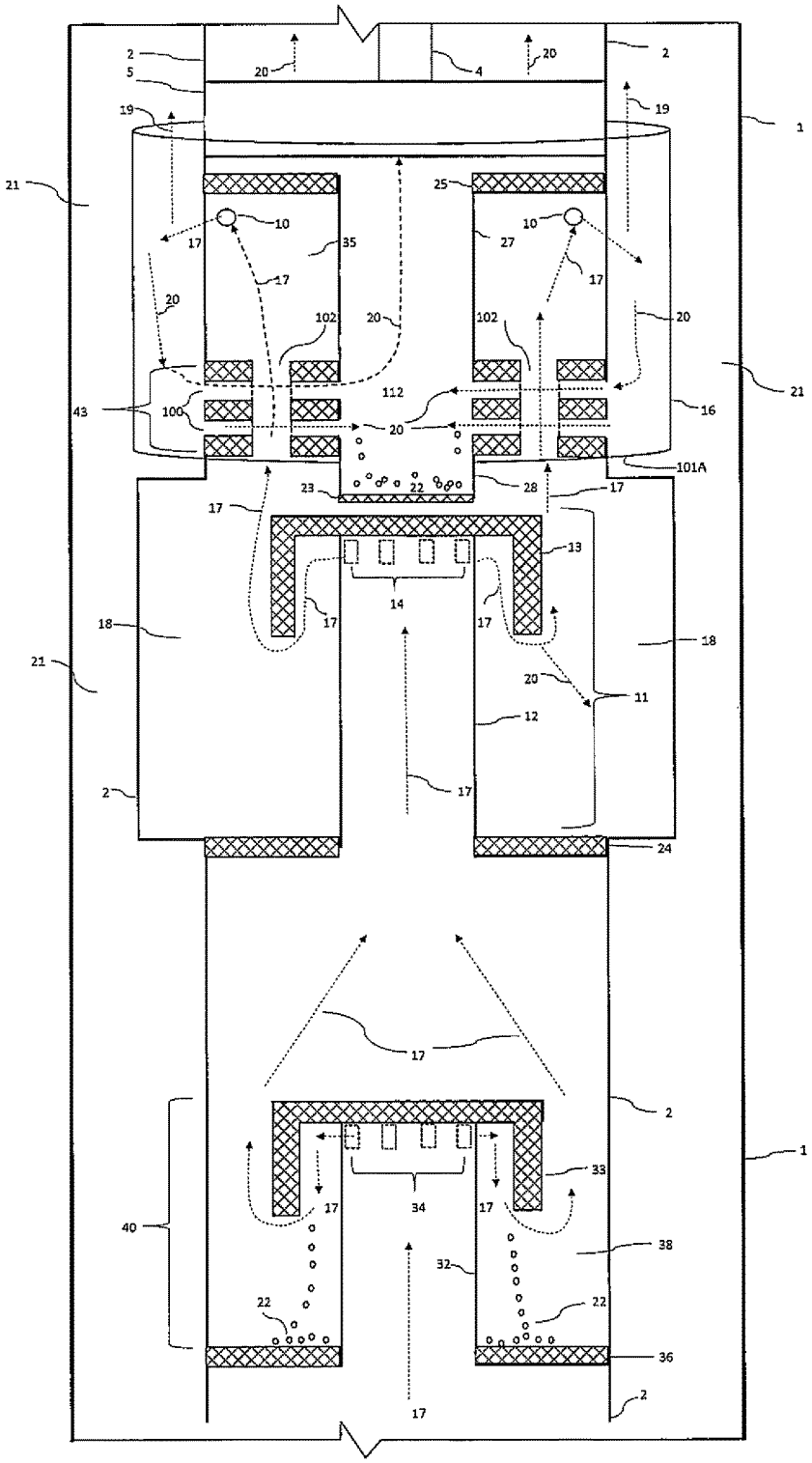
FIG. 12B is a diagram of an embodiment similar to FIG. 12A except without a casing annular sealing device and with a shield surrounding the bi-flow connector according to the present disclosure.

FIG. 12A shows another embodiment of the gas and solids separation system with a bi-flow connector 43. The tubular string 2 is disposed in the casing 1. The casing annulus 21 is formed by the tubular string 2 and the casing 1. Along its length, the tubular string 2 may vary in diameter to accommodate internal components or annular spacing from the casing 1 as would be understood by a person of ordinary skill in the art. The volume of the casing 1 is separated into an upper portion and a lower portion by a casing annular sealing device 3. In some embodiments, the casing annular sealing device 3 may be a packer. A solids collection device 40 may be disposed in the tubular string 2 below the casing annular sealing device 3. The solids collection device 40 may include an inner tubular 32 forming an annulus 38 between the inner tubular 32 and the tubular string 2. The annulus 38 may be sealed below the inner tubular 32 by a casing solids collection annular sealing device 36. In some embodiments, the casing solids collection annular sealing device 36 may be a bushing. The inner tubular 32 may include a cover 33 to prevent flow out of the top of the inner tubular 32 and one or more openings 34 to allow flow of the reservoir fluids 17 between the interior of the inner tubular 32 and the annulus 38. In some embodiments, the cover 33 may contain one or more sections of screen that will allow gas and liquids to flow through the screen or screens but will prevent passage of at least some of the solids and redirect these solids downward. The screen or screens may be selected to block solids with a particle size above a selected threshold. The solids collection device 40 is configured to allow at least some of the solids 22 entrained in the reservoir fluids 17 to fall out of the reservoir fluids 17 as they move through the solids collection device 40. As the solids 22 fall out, they will collect on top of the casing solids collection annular sealing device 36.

Similarly, a solids collection device 1 may be disposed in the tubular string 2 above the casing annular sealing device 3. The solids collection device 1 may include an inner tubular 12 forming an annulus 18 between the inner tubular 12 and the tubular string 2. The annulus 18 may be sealed below the inner tubular 12 by a solids collection annular sealing device 24. In some embodiments, the solids collection annular sealing device 24 may be a bushing. The inner tubular 12 may include a cover 13 to prevent flow out of the top of the inner tubular 12 and one or more openings 14 to allow flow of the reservoir fluids 17 between the interior of the inner tubular 12 and the annulus 18. In some embodiments, the cover 13 may contain one or more sections of screen similar to the cover 33. The solids collection device 11 is configured to allow at least some of the solids 22 entrained in the reservoir fluids 17 to fall out of the reservoir fluids 17 as they move through the solids collection device 11. The use of two solids collection devices 11, 40 is illustrative and exemplary, as one or more solids collection devices 11, 40 may be used with the system. Additionally, the inner tubular string within the solids collection devices 11, 40 may extend below the annular sealing devices 24, 36, respectively. The tubular string 2 includes an optional at least one opening 15 located above the solids collection annular sealing device 24 but below the one or more openings 14 to allow the flow of the solids 22 and the liquids 20 into the casing annulus 21. When the at least one opening 15 is present, the solids 22 that fall out of the fluids passing through the at least one opening 15 may be collected in the shield 16.

The shield 16 with the disk or end cap 101A may be disposed in the casing 1 so as to surround the tubular string 2 above the casing annular sealing device 3 and below the at least one opening 15. The shield 16 may extend higher if the at least one opening 15 is not present. The shield 16 may be dimensioned so that it covers some, or substantially all, of the upper surface of the casing annular sealing device 3. When in place, the shield 16 may catch falling debris and prevent it from accumulating on top of the casing annular sealing device 3. The shield 16 is sized to cover the casing annular sealing device 3 but with sufficient space between the shield 16 and the casing 1 so that the shield 16 may be lifted to remove the accumulated debris. In FIG. 12A, the shield 16 is shown extending upward to a point below the solids collection annular sealing device 24; however, this is exemplary and illustrative only. The shield 16 may extend from the casing annular sealing device 3 or any point below the at least one opening 15 to any point above, so long as the shield 16 is positioned to capture solids 22 that may separate from the reservoir fluids 17 coming into a casing annulus 21 formed by the space between the casing 1 and the tubular string 2 through the at least one opening 15. In some embodiments, the shield 16 may be the end cap 101A.

Above the solids collection device 11, a bi-flow connector 43 may be disposed in the tubular string 2. The bi-flow connector 43 is configured to allow two independent fluid flow paths. As shown, the bi-flow connector 43 allows flow of the reservoir fluids 17 through one or more channels 102 from the solids collection device 11 to an annulus 35 formed by the tubular string 2 and an inner tubular 27. The bi-flow connector 43 also allows flow between the casing annulus 21 and an inner bore 112 of the bi-flow connector through one or more channels 100. The inner bore 112 is connected to the inner tubular 27 (e.g. "bi-flow inner tubular") on the end of the bi-flow connector nearer to the surface and the inner bore 112 is connected to an optional mud anchor 28 with a blind sub 23 on bottom on the opposing end of the bi-flow connector 43. If the mud anchor 28 is not installed, the inner bore 112 is not open to flow on the bottom of the bi-flow connector 43. The inner tubular 27 is connected to an annular sealing device 25 disposed in the tubing string 2 above the bi-flow connector 43. In one embodiment, the annular sealing device 25 is a bushing. One or more openings 10 are disposed in the tubular string 2 between the bi-flow connector 43 and the annular sealing device 25. The one or more openings 10 allow flow between the casing annulus 21 and the annulus 35. Above the annular sealing device 25, the fluid displacement device 5 is disposed. The fluid displacement device 5 may be seated in the annular sealing device 6, if present. As shown, the rods 4 are positioned to drive the fluid displacement device 5. The rods 4 and the annular sealing device 6 may not be installed if a fluid displacement device other than a rod pump is used. Additionally, the tubular string 2 may be tapered with varying diameters. In embodiments where the at least one opening 15 is present, an optional shroud 7 (not shown) may be installed around the bi-flow connector 43 similar to FIG. 4 or centered around bi-flow connector 43. Though shown with the one or more channels 100 on opposite sides of the bi-flow connector 43, other configurations are contemplated, including, but not limited to: one or more channels 100 aligned on one side of the bi-flow connector 43. It is also contemplated that the one or more channels 100 may be aligned on the opposite side of the wellbore from the at least one opening 15.

In operation, for FIG. 12A, the reservoir fluids 17 leaving the solids collection device 11 may have some of the liquids 20 fall out and move out of the annulus 18 into the casing annulus 21 through the one or more openings 15. Separately, some of the reservoir fluids 17 may travel upward through the one or more channels 102 to the annulus 35. From the annulus 35, the reservoir fluids 17 may exit into the casing annulus 21 through the one or more openings 10, where the gas 19 will travel up the wellbore and the liquids 20 will fall. The liquids 20 exiting the one or more openings 15 and the liquids 20 falling out after leaving the one or more openings 10 may enter the one or more channels 100 of the bi-flow connector 43. The liquids 20 move into the inner bore 112 and into the inner tubular 27, and, from the inner tubular 27, into the fluid displacement device 5 for pumping to the surface.

FIG. 12B is similar to FIG. 12A except that there is no casing annular sealing device 3 and no one or more openings 15, and a shroud 7 is placed around the one or more second channels 100 in the bi-flow connector 43 and extends upward to surround the one or more openings 10. The end cap 101A is placed on the end of the shroud 7 farthest from the surface while the end closest to the surface is open. The shroud 7 may be disposed in a centered or off-centered position around the bi-flow connector 43. It is also contemplated that the one or more channels 100 may exist only on one side of the bi-flow connector 43. Also, the shroud 7 may be closed at the top and bottom with one or more openings on one side.

The operation for FIG. 12B is similar to the operation of FIG. 12A, except that the reservoir fluids 17 exit into the annulus 21 through the one or more openings 10, and then travel into the shield 16, where the gas 19 separates from the liquids 20 and travels to the surface through annulus 21. The liquids 20 travel downward through shield 16 and travel into the one or more channels 100, through the inner bore 112, and up the inner tubular 27 and into the intake of fluid displacement device 5, where liquids 20 are pumped to the surface through the tubular 2.

Figure 13A:
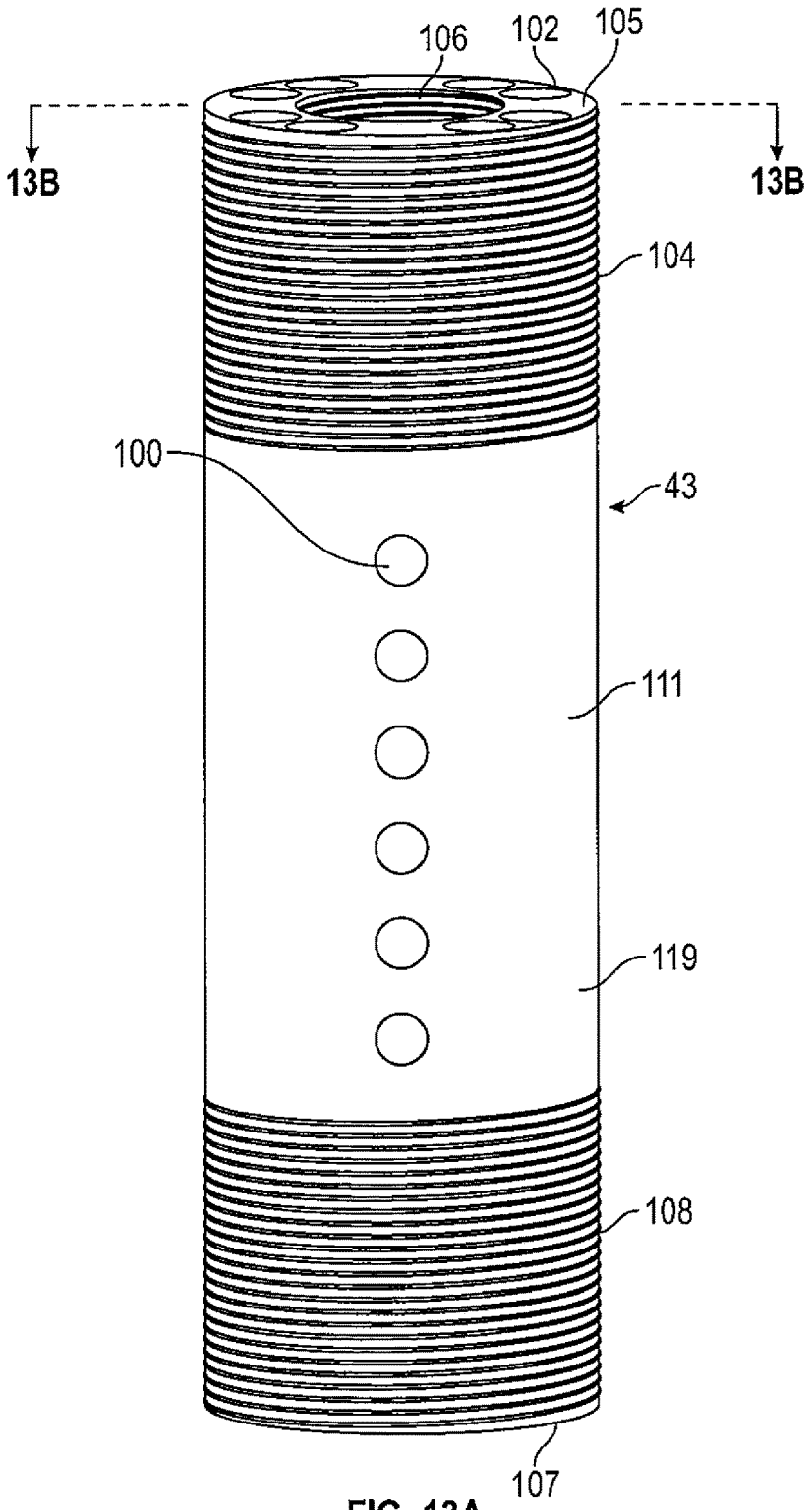
FIG. 13A is an 3D view of the bi-flow connector.
Figure 13B:
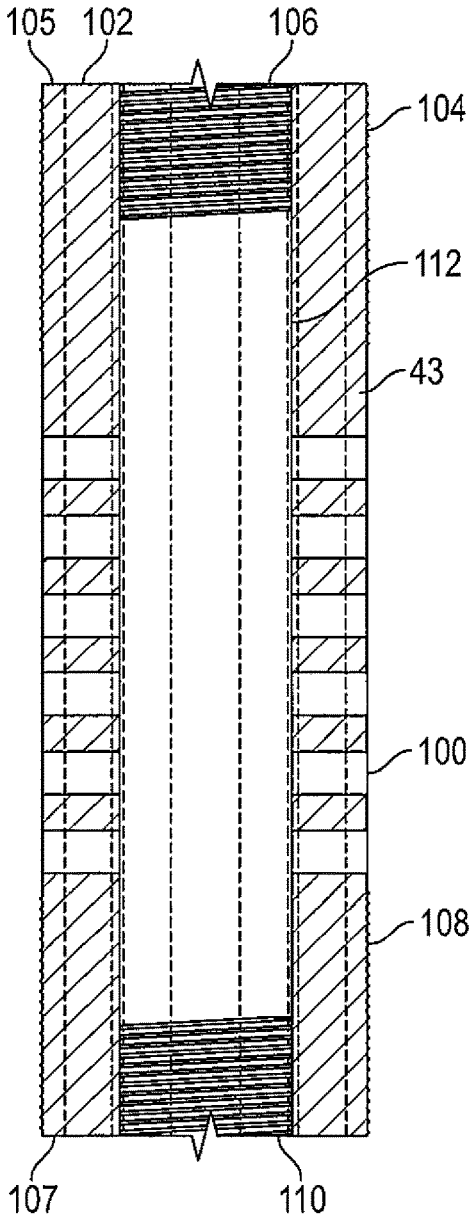
FIG. 13B is a section view along 13A-13A of FIG. 13A.
Figure 13C:
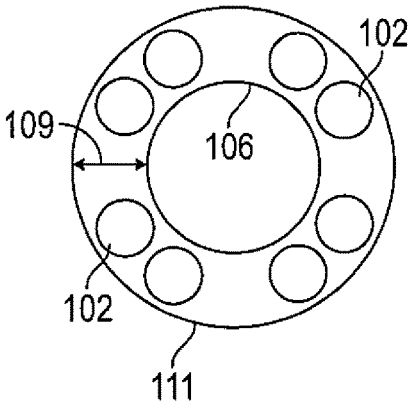
FIG. 13C is a top view of FIG. 13A.
Figure 13D:
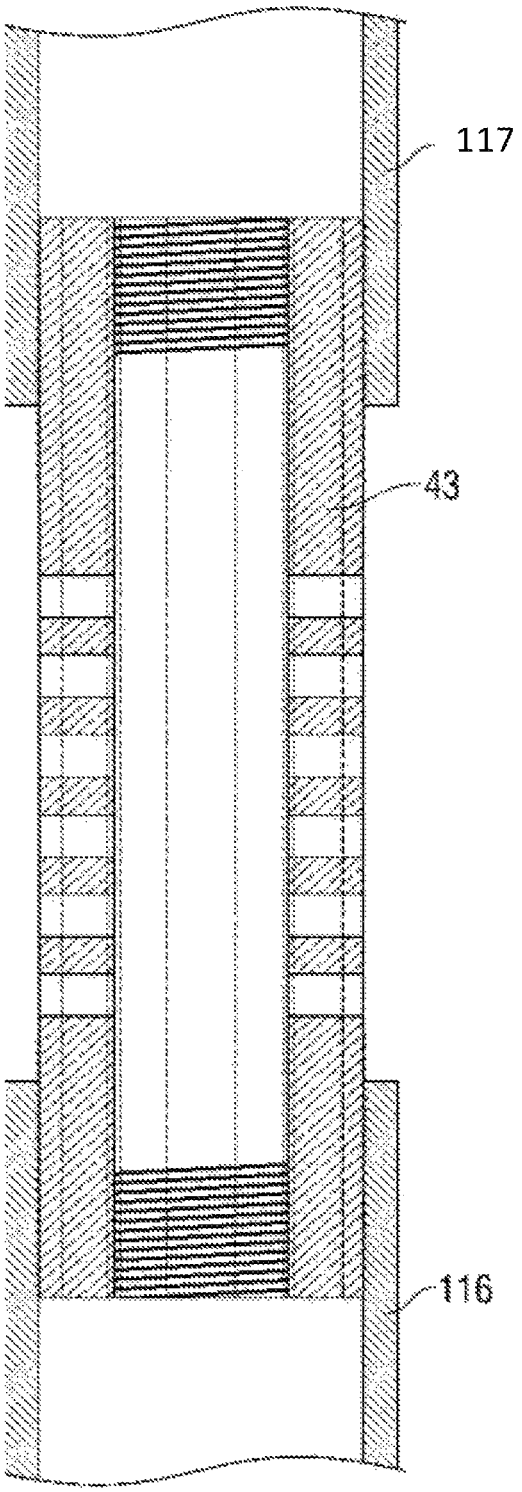
FIG. 13D is a section view similar to FIG. 13B with tubing couplings shown.

FIGS. 13A-13D show the bi-flow connector 43. FIG. 13A shows the bi-flow connector as a cylindrically shaped body 119 with an inner bore 112 (FIG. 13B) extending from a first end 105 to a second end 107 and having a thickness 109 (FIG.13C). One or more channels 102 pass through the thickness 109 of the bi-flow connector 43 from the end 105 to the end 107. The channels 100 pass from a side surface 111 through the thickness 109 of the bi-flow connector 43 to the inner bore 112. When multiple channels 100 are present, they may be arranged in one or more groups. As shown in FIG. 13A, the channels 100 may be aligned vertically. It is contemplated that a corresponding group of channels 100 (each group with one or more channels 100) may be on the opposite side of the bi-flow connector. It is also contemplated that a group of channels 100 may be present at an angle other than 180 degrees. In one exemplary, non-limiting embodiment, there may be four groups of channels 100 spaced at 90 degree intervals around the circumference of the bi-flow connector 43. While FIG. 13C shows the spacing of the one or more channels 102 as grouped in a pairs, this is illustrative and exemplary only, as the one or more channels 102 may be grouped or spaced in any pattern so long as the one or more channels 102 and the one or more channels 100 do not intersect. Although shown vertical and horizontal, it is also contemplated that the channels 100 and the channels 102 may have different orientations relative to the inner bore 112 and relative to one another (i.e. the channels 100 and the channels 102 do not need to be at right angles to one another). Different numbers and orientations of channels are contemplated as well as having one large channel 100 and one large channel 102. While shown as cylindrical in shape, the channels 100 and the channels 102 are not limited to cylindrical or near cylindrical shapes. The channels 100 and the channels 102 do not intersect. Threads 104 are disposed on the side surface 111 near the end 105, and threads 108 are disposed on the side surface 111 near the end 107. There may also be inner threads 106 and 110 on the inner surface of inner bore 112 adjacent to the ends 105 and 107, respectively. FIG. 13D shows the threaded couplings 117, 116 on either end of bi-flow connector 43.

Returning to FIG. 12A-12B, it can be seen in this embodiment that the bi-flow connector 43 allows the reservoir fluids 17 to pass through the one or more channels 102 in the bi-flow connector 43 while simultaneously allowing the liquids 20 to pass through the channels 100 in the bi-flow connector 43, without commingling the liquids 20 and the reservoir fluids 17. As can also be seen, the large cross-sectional of the casing annulus 21 between the one or more openings 10 and the one or more channels 100, similar to FIGS. 2-4, allow the gas 19 to separate out and travel up the casing annulus 21 to the surface without being drawn into the one or more channels 100 and subsequently into the intake of the fluid displacement device 5.

In FIGS. 2, 3, 4, and 12A, the single solids collection device 40 shown below the casing annular sealing device 3 and the single solids collection device 11 shown above the casing annular sealing device 3 are illustrative and exemplary only, as multiple solids collection devices 11, 40 may be present above or below the casing annular sealing device 3, respectively. In some embodiments, one or both of the solids collection devices 11, 40 may be optional. In some embodiments, the addition of the solids collection chamber 11 aids in gas separation by channeling part of the liquids 20 from the reservoir fluids 17 through the one or more openings 15. As shown, the solids collection chambers 11, 40 separate the solids 22 and trap them either in the shield 16 or in the annulus 38 in the solids collection device 40 before these solids 22 can settle out on top of the casing annular sealing device 3 or enter into the fluid displacement device 5. It is contemplated that multiple solids collection devices 40 and/or shields 16 may be used to trap more of the solids 22, if necessary. Additionally, the inner tubular string within the solids collection devices may extend below the annular sealing devices 24, 36. While many components are listed within and shown in the figures, a person of ordinary skill in the art would understand that not all of the components are required to be incorporated in every wellbore, and that the optional components may not be present without compromising the novelty of the embodiments of the present disclosure.

Returning to FIG. 1, it would be understood by a person of ordinary skill in the art that the cross-sectional area between the tubular string 2 and the inner tubular 12 is necessarily small inside an exemplary casing 1 with an outer diameter of 5½ inches (13.97 cm) or 4½ inches (11.43 cm). This small cross-sectional area greatly limits the production rate of the liquids 20 before the gas 19 will begin to enter the intake of the pump 5. Further, the velocities of the reservoir fluids 17 at higher production rates are too high to allow the settling of the solids 22 into the mud anchor 28.

In contrast, as shown in FIGS. 2-4, the proposed gas and solid separation method and system provides, in various aspects, both gas and solids separation in a packer type separation system. The reservoir fluids 17 are forced through the one or more openings 9 and into the large cross-sectional area of the casing annulus 21 above the shroud 7 (FIG. 2), the diverter 88 (FIG. 3) or the shroud 89 (FIG. 4). This cross-sectional area above the shroud/diverter may be about 15 times larger than the cross-sectional area of a conventional separator (using a 5½ inch (13.97 cm) casing and a 2⅜ inches×1.66 inches (6.03 cm×3.18 cm) separator shown in FIG. 1. Even if the conventional separator were increased to dimensions of 2⅞ inches×1.66 inches (7.03 cm×3.18 cm), the embodiments of the present disclosure would provide a cross-sectional area that is about 5.7 times larger.

In one aspect, the gas 19 may be kept out of the intake of the fluid displacement device 5 by preventing the gas 19 from being in close proximity of the intake. A person of ordinary skill in the art would understand that the operation of fluid displacement device 5 will define a zone surrounding the intake where any gas in close proximity could be sucked into the intake, for example, during stroking of the fluid displacement device 5. In some embodiments, the gas 19 may be kept clear of the one or more openings 10, the one or more openings 30, and/or the one or more openings 31 by strategically placing the one or more openings 9 substantially on the opposite side of the wellbore from the one or more openings 10, the one or more openings 30, and/or the one or more openings 31.

Furthermore, the shroud 7 and the diverter 88, in their respective embodiments, enhance gas separation by forcing the reservoir fluids 17 to exit from the tubular string 2 into the casing annulus 21 above the one or more openings 10 and the one or more openings 30 to allow the gas 19 to separate out and travel to the surface, essentially creating a sump for the intake of fluid displacement device 5.

Additionally, the reservoir fluids 17 are concentrated and substantially vertically directed, when exiting the shroud 7, the shroud 89, the diverter 8, and the diverter 88, into a higher velocity directed stream than would be present if the reservoir fluids 17 were merely moving into the casing annulus 21 from the one or more openings 9. This higher velocity stream carries the gas 19 even further up the wellbore and away from the one or more openings 10 and the one or more openings 30, creating even better gas separation.

While the disclosure has been described with reference to exemplary embodiments, it will be understood that various changes may be made and equivalents may be substituted for elements thereof without departing from the scope of the disclosure. In addition, many modifications will be appreciated to adapt a particular instrument, situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A separation system for use in a wellbore extending from the surface to a reservoir having reservoir fluids, and the wellbore containing:

a casing disposed in the wellbore;

a tubular string disposed in the casing;

a casing annular sealing device disposed in the casing and sealingly engaged to the tubular string to form an annular barrier for a casing annulus between the casing and the tubular string; and a shield disposed around the tubular string, above the casing annular sealing device, and dimensioned to substantially cover a surface of the casing annular sealing device and to substantially extend from the tubular string to the casing, wherein the shield is open at the top and comprises a circumferential side raised to define a volume above the shield;

wherein one or more openings are disposed in a wall of the tubular string above the casing annular sealing device, and wherein none of the one or more openings are between the shield and the casing annular sealing device.

2. The system of claim 1, wherein the shield comprises an end cap with an inner opening dimensioned to receive the tubular string wherein the end cap encloses the lower end of the shield.

3. The system of claim 2, wherein the end cap comprises at least one of:

one or more slits radiating from the inner opening; and threads along the circumference of the inner opening.

4. The system of claim 2, wherein the end cap further comprises a tubular shield wall.

5. The system of claim 4, wherein at least one of: 1) the end cap and the tubular wall and 2) the shield and the tubular string are secured to each other by a weld, a fastener, a bonding agent, cement, a compression fitting, a friction fitting, and a threaded connection.

6. The system of claim 2, wherein the end cap is an integral part of the shield.

7. The system of claim 1, further comprising:

a first solids collection device disposed in the tubular string and connected to the first solids collection annular sealing device, the first solids collection device comprising:

a first inner tubular connected to the first solids collection annular sealing device, wherein the first inner tubular has one or more openings;

a first solids collection annulus formed by the first inner tubular and the tubular string, wherein the first solids collection annular sealing device forms an annular seal between the tubular string and the first inner tubular; and a first cover disposed on an end of the first inner tubular opposite the first solids collection annular sealing device above the one or more openings in the first inner tubular, wherein the first cover is configured to redirect flow out of the one or more openings in the first inner tubular.

8. The system of claim 7, further comprising:

a fluid displacement device disposed in the tubular string above the solids collection device.

9. The system of claim 8, further comprising:

a flow blocking device disposed in the tubular string between the first fluid displacement device and the solids collection device, wherein the tubular string further comprises:

one or more openings below the flow blocking device and above the first solids collection device configured to allow flow between the interior of the tubular string and the casing annulus; and one or more openings below the fluid displacement device and above the flow blocking device configured to allow flow between the casing annulus and the interior of the tubular string; and a first shroud comprising a tubular disposed in an off-centered position about the tubular string and surrounding at least one of: 1) said one or more openings below the flow blocking device and 2) the one or more openings above the flow blocking device, wherein said first shroud is configured to divert the flow of said reservoir fluids emanating from said one or more openings below said flow blocking device away from said one or more openings above the flow blocking device.

10. The system of claim 8, further comprising:

a bi-flow annular sealing device disposed in the tubular string below the fluid displacement device and above the first solids collection device;

a bi-flow inner tubular connected to the bi-flow annular sealing device and extending downward from the bi-flow annular sealing device; and a bi-flow connector disposed in the tubular string above the first solids collection device and sealingly engaged with the bi-flow inner tubular, wherein the tubular string comprises one or more openings above the bi-flow connector and below the bi-flow annular sealing device configured to allow flow between a bi-flow annulus and the casing annulus, wherein the bi-flow annulus is formed by the bi-flow inner tubular and the tubular string.

11. The system of claim 10, wherein the bi-flow connector comprises:

a tubular with a first end, a second end, an inner bore and a thickness;

one or more first channels through the thickness configured to allow fluids to pass from outside the thickness to the inner bore; and one or more second channels through the thickness configured to allow fluids to pass from the first end to the second end, wherein the one or more first channels and the one or more second channels do not intersect, wherein the shield surrounds the one or more second channels and the one or more openings above the bi-flow connector with a closed end of the shield farthest from the surface and an open end of the shield closest to the surface.

12. The system of claim 1, wherein said shield comprises a tubular.

13. The system of claim 12, wherein the shield is made of at least one of: polymer, resin, fiberglass, metal, carbon, carbon fiber, cement, plastic, elastomer, and ceramic.

14. The system of claim 12, where the shield is secured to the tubular string by at least one of: a weld, a fastener, a bonding agent, cement, a compression fitting, a friction fitting, and a threaded connection.

15. A separator system for use in a wellbore extending from a surface to a subterranean reservoir, the system comprising:

a casing disposed in the wellbore;

a tubular string extending into the casing;

a first solids collection annular sealing device disposed in the tubular string; and a first solids collection device disposed in the tubular string and connected to the first solids collection annular sealing device, the first solids collection device comprising:

a first inner tubular connected to the first solids collection annular sealing device, wherein the first inner tubular has one or more openings;

a first solids collection annulus formed by the first inner tubular and the tubular string, wherein the first solids collection annular sealing device forms an annular seal between the tubular string and the first inner tubular;

a first cover disposed on an end of the first inner tubular opposite the first solids collection annular sealing device above the one or more openings in the first inner tubular, wherein the first cover is configured to redirect flow out of the one or more openings in the first inner tubular;

a fluid displacement device disposed in the tubular string above the first solids collection device;

a casing annular sealing device disposed in the casing and sealingly engaged to the tubular string and forming an annular barrier in a casing annulus between the casing and the tubular string; and a shield disposed around the tubular string, above the casing annular sealing device and below the one or more openings in tubular string above the flow blocking device, wherein the shield is dimensioned to substantially cover a surface of the casing annular sealing device.

* * * * *